US009800024B2

(12) United States Patent
Obe et al.

(10) Patent No.: US 9,800,024 B2
(45) Date of Patent: Oct. 24, 2017

(54) IGNITER AND VEHICLE, AND METHOD FOR CONTROLLING IGNITION COIL

(71) Applicant: Rohm Co., Ltd., Kyoto (JP)

(72) Inventors: Katsuya Obe, Kyoto (JP); Hiroyuki Tanigawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 162 days.

(21) Appl. No.: 14/935,763

(22) Filed: Nov. 9, 2015

(65) Prior Publication Data

US 2016/0134085 A1 May 12, 2016

(30) Foreign Application Priority Data

Nov. 11, 2014 (JP) ..... 2014-229244

(51) Int. Cl.
*H01T 15/00* (2006.01)
*F02P 5/15* (2006.01)

(52) U.S. Cl.
CPC ..... *H01T 15/00* (2013.01); *F02P 5/1502* (2013.01)

(58) Field of Classification Search
CPC ..... H01T 15/00; F02P 5/15; F02P 5/1502
See application file for complete search history.

(56) References Cited

U.S. PATENT DOCUMENTS 3,832,986 A * 9/1974 Dogadko ..... F02P 3/0884 123/598
4,617,905 A * 10/1986 Hill ..... F02P 5/1558 123/614
6,973,911 B2 * 12/2005 Yamashita ..... F02P 1/086 123/335
2016/0084214 A1 * 3/2016 Okuda ..... F02D 37/02 123/478

FOREIGN PATENT DOCUMENTS

JP 2011-185165 9/2011
JP 2014-051904 3/2014

* cited by examiner

*Primary Examiner* — Hieu T Vo
(74) *Attorney, Agent, or Firm* — Fish & Richardson P.C.

(57) ABSTRACT

An igniter that includes switch element and switch control device for controlling the switch element depending on ignition signal. The switch control device includes a determination stage that compares voltage associated with the ignition signal with a predetermined voltage to generate a determination signal, a driving stage that controls ON/OFF operations of the switch element depending on the determination signal, a timer circuit that asserts a conduction protection signal when state where the determination signal becomes an assert level corresponding to an ON operation of the switch element continues for predetermined time, a time-varying voltage generating circuit that generates time-varying voltage over time in response to the assertion of the conduction protection signal, and an amplifier that changes the voltage of a control terminal of the switch element such that detection voltage associated with coil current flowing in the switch element is close to the time-varying voltage.

26 Claims, 19 Drawing Sheets

324a

324b

IGNITER AND VEHICLE, AND METHOD FOR CONTROLLING IGNITION COIL

CROSS-REFERENCE TO RELATED APPLICATION

This application is based upon and claims the benefit of priority from Japanese Patent Application No. 2014-229244, filed on Nov. 11, 2014, the entire contents of which are incorporated herein by reference.

TECHNICAL FIELD

The present disclosure relates to an igniter for controlling an ignition coil connected to an ignition plug of an engine.

BACKGROUND

FIG. 1 is a perspective view of an engine room 101 of a gasoline engine vehicle (hereinafter, simply referred to as a "vehicle") 100. An engine 110, an intake manifold 112, an air cleaner 113, a radiator 114, a battery 102, and the like are accommodated in the engine room 101. A 4-cylinder engine is illustrated in FIG. 1.

A plug hole (not shown) is installed in every cylinder of the engine 110, and an ignition plug (not shown) is inserted in each plug hole. A mixture of air which has passed through the air cleaner 113 and the intake manifold 112 and fuel from a fuel tank (not shown) is supplied to each cylinder of the engine 110. The engine 110 is started and rotated by igniting (sparking) an ignition plug at an appropriate timing.

FIG. 2 is a block diagram of part of an electric system of a vehicle 100*r*. The electric system of the vehicle 100*r* has a battery 102, an ignition coil 104, an ignition plug 106, an engine control unit (ECU) 108, and an igniter 200*r*. The ECU 108 periodically generates an ignition signal (ignition timing (IGT)) for indicating an ignition timing of the ignition plug 106 in synchronization with a rotation of the engine 110. A secondary coil L2 of the ignition coil 104 is connected to the ignition plug 106. The igniter 200*r* generates a high voltage (secondary voltage $V_S$) of tens of kV in the secondary coil L2 by controlling a current of a primary coil L1 of the ignition coil 104 depending on the ignition signal IGT, and discharges the ignition plug 106 to explode a mixer within the engine 110.

The igniter 200 has a switch element 202 and a switch control device 300*r*. The switch element 202 is, for example, an insulated gate bipolar transistor (IGBT), in which a collector thereof is connected to the primary coil L1 and an emitter thereof is grounded. The switch control device 300*r* controls a voltage of a control terminal (gate) of the switch element 202 depending on the ignition signal IGT to control ON/OFF of the switch element 202. Specifically, the switch control device 300*r* turns on the switch element 202 during a period in which the ignition signal IGT becomes a high level. When the switch element 202 is turned on, a battery voltage $V_{BAT}$ is applied across the primary coil L1, so that a current flowing in the primary coil L1 is increased over time. When the ignition signal IGT transitions to a low level, the switch control device 300*r* immediately turns off the switch element 202 to cut off a current $I_{L1}$ of the primary coil L1. At this time, a primary voltage $VI_{L1}$ ($=L \cdot dI_{L1}/dt$) of hundreds of V proportional to temporal derivatives of the current $I_{L1}$ is generated in the primary coil L1. At this time, a secondary voltage $V_S$ of tens of kV obtained by multiplying a winding ratio to the primary voltage $VI_{L1}$ is generated in the secondary coil L2.

The switch control device 300*r* largely has a determination stage 300A and a driving stage 300B. The determination stage 300A receives an ignition signal IGT from the ECU 108 and determines a level (high or low) of the ignition signal IGT. For example, the determination stage 300A includes a determination comparator 302 for comparing a voltage $V_{IN}$ of an input line 301 with a reference voltage $V_{REF}$ to generate a determination signal $S_{DET}$ having a high/low value.

The driving stage 300B switches ON/OFF the switch element 202 depending on the determination signal $S_{DET}$. A delay circuit 304 provides predetermined delay to the determination signal $S_{DET}$. The delay amount is set such that a time difference (delay) between a time at which the ignition signal IGT transitions and a time at which the ignition plug is discharged has a predetermined value. A pre-driver 306 and a gate driver 308 control a gate voltage of the switch element 202 depending on an output from the delay circuit 304.

When the ECU 108 normally operates, after the ignition signal IGT becomes a high level, the ignition signal IGT transitions to a low level to ignite the ignition plug 106 after the lapse of an appropriate period of time. However, when the ECU 108 has an error, the ignition signal IGT maintains the high level, rather than transitioning to a low level, so that the switch element 202 is maintained in the ON state. Then, problems may arise such as an increase in heat generated by the switch element 202 or a large amount of current flowing in the primary coil L1 of the ignition coil 104.

In order to solve the above problems, a conduction protection circuit 310 is installed. When the ignition signal IGT transitions to a high level and a predetermined conduction protection time $T_P$ has lapsed, the conduction protection circuit 310 forcibly turns off the switch element 202 to ignite the ignition plug 106. FIG. 3A is a waveform view illustrating an operation of the conduction protection circuit 310. When the ignition signal IGT transitions to a high level, the switch element 202 is turned on to increase a coil current (collector current of IGBT). The conduction protection circuit 310 includes a timer, which measures a time duration in which the ignition signal IGT (determination signal STET) becomes a high level. Further, when a count value of the timer reaches a setting value (##) corresponding to the conduction protection time $T_P$, the switch element 202 is forcibly turned on to cut off the coil current $I_C$. In this case, due to the forcible cutoff of the coil current $I_C$, the voltage (secondary voltage $V_S$) of the secondary coil L2 of the ignition coil 104 is significantly changed and the ignition plug 106 is ignited.

In some cases, the ignition of the ignition plug 106 by the forcible OFF of the switch element 202 is not desirable depending on the type of engines and ECUs. In this case, as illustrated in FIG. 3B, a soft shutoff function of gradually turning off the switch element 202 after the lapse of the conduction protection time $T_P$, and gradually decreasing the coil current $I_C$ is required.

In order to prevent ignition of turn-off of the switch element 202 according to the conduction protection, it is required to reduce the coil current $I_C$ to a long time scale $T_{SSO}$ ranging from tens of ms to hundreds of ms, and to this end, it is required to lower a gate voltage of the switch element 202 from a high level voltage (for example, 5 V) to a low level voltage (0 V) by a time scale ranging from tens of ms to hundreds of ms. This is called a soft shutdown function.

SUMMARY

The present disclosure provides some embodiments of an igniter having a soft shutdown function.

According to one embodiment of the present disclosure, there is provided an igniter, including: a switch element connected to a primary coil of an ignition coil; and a switch control device configured to control the switch element depending on an ignition signal from an engine control unit (ECU), wherein the switch control device includes: a determination stage configured to compare a voltage associated with the ignition signal with a predetermined reference voltage to generate a determination signal; a driving stage configured to control ON/OFF operations of the switch element depending on the determination signal; a timer circuit configured to assert a conduction protection signal when a state where the determination signal becomes an assert level corresponding to the ON operation of the switch element continues for a predetermined conduction protection time; a time-varying voltage generating circuit configured to generate a time-varying voltage which decreases from an initial voltage over time in response to the assertion of the conduction protection signal; and an amplifier configured to change a voltage of a control terminal of the switch element such that a detection voltage associated with a coil current flowing in the switch element is close to the time-varying voltage.

In this embodiment, when the conduction protection signal is asserted, the time-varying voltage decreases, and a voltage of the control terminal of the switch element decreases such that the detection voltage follows the time-varying voltage. Thus, it is possible to realize soft shutdown by gradually lowering the time-varying voltage.

The amplifier is configured to sink a current from the control terminal of the switch element. By doing so, the amplifier acts only in a direction to lower the voltage of the control terminal of the switch element, thus preventing an increase of the coil current.

When the detection voltage is higher than the time-varying voltage, the amplifier may be configured to change the voltage of the control terminal of the switch element such that the detection voltage is close to the time-varying voltage.

The amplifier may include: an output transistor installed between the control terminal of the switch element and a ground line; and a voltage comparator configured to compare the detection voltage with the time-varying voltage, and turn on the output transistor when the detection voltage exceeds the time-varying voltage.

The amplifier may include: an output transistor installed between the control terminal of the switch element and a ground line; and an error amplifier configured to adjust the voltage of the control terminal of the output transistor depending on a difference between the detection voltage and the time-varying voltage.

The time-varying voltage generating circuit may include: a first node at which the time-varying voltage is output; a first resistor installed between a first voltage line regulated with a predetermined first voltage level and the first node; and a variable impedance circuit installed between the first node and a ground line. In response to the assertion of the conduction protection signal, an impedance of the variable impedance circuit decreases from an initial impedance corresponding to the initial voltage toward zero over time.

When it is assumed that the first voltage level is $V_{REG}$, a resistance value of the first resistor is R1, and an impedance of the variable impedance circuit is Rv, the time-varying voltage $V_{SSO}$ of Eq. (1) may be generated.

$$V_{SSO}=V_{REG}\times Rv/(R1+Rv) \quad \text{Eq. (1)}$$

Further, by lowering the impedance Rv of the variable impedance circuit from the maximum value $R_{MAX}$ toward the minimum value $R_{MIN}$ (zero), the time-varying voltage $V_{SSO}$ may be changed from $V_{REG}\times R_{MAX}/(R1+R_{MAX})$ to 0.

The variable impedance circuit may include: a second resistor installed between the first node and the ground line; a first transistor installed to be parallel to the second resistor; and a slope voltage source configured to generate a first slope voltage increased over time and supply the generated first slope voltage to a control terminal of the first transistor in response to the assertion of the conduction protection signal.

In this configuration, the impedance Rv of the variable impedance circuit is a combined resistance of the resistance value R2 of the second resistor and an ON resistance (OFF resistance) of the first transistor. When the first slope voltage is applied to the control terminal of the first transistor, the ON resistance thereof is lowered over time. Thus, the impedance of the variable impedance circuit may be lowered over time.

The first slope voltage source may include: a first capacitor; a first current source configured to supply a predetermined current to the first capacitor; and a first switch installed to be parallel to the first capacitor, and in which ON/OFF operations of the first switch are controlled in response to the conduction protection signal. A voltage of the first capacitor may be the first slope voltage.

With this configuration, it is possible to generate the first slope voltage increased linearly over time, and a metal oxide semiconductor field effect transistor (MOSFET) may be used as the first transistor to appropriately adjust the ON resistance (OFF resistance) thereof.

The variable impedance circuit may include: a plurality of (N number of) (where N is an integer of 2 or greater) variable impedance elements connected in series, and an impedance controller configured to control the plurality of (N number of) variable impedance elements. Each of the variable impedance elements is configured such that an impedance of each of the variable impedance elements varies between a predetermined minimum value and a predetermined maximum value depending on the control signal. The impedance controller may be configured to sequentially select one of the plurality of (N number of) variable impedance elements and change an impedance of the selected variable impedance element from the maximum value toward the minimum value over time.

According to this embodiment, a long time constant may be obtained by sequentially controlling the plurality of variable impedance elements using a short time constant. Thus, it is possible to generate a long time constant within an integrated circuit (IC) without using an external capacitor, a resistor, and the like.

The impedance controller may include: a first slope voltage source configured to start an operation to periodically repeatedly generate a first slope voltage increased over time in response to the assertion of the conduction protection signal; and a counter configured to receive a period signal asserted at every period of the first slope voltage to generate an N-bit thermometer code. The impedance controller may be configured to select one of the variable impedance elements based on the thermometer code, control an impedance of the selected variable impedance element depending on the first slope voltage, and fix the impedance of the selected variable impedance element as the minimum value depending on the thermometer code.

Each of the variable impedance elements may include: a second resistor; a first transistor and a second transistor installed in series between one end of a high potential side of the second resistor and the ground line; and a third transistor installed between one end of a high potential side of the second resistor and the ground line. The impedance controller may be configured to output the first slope voltage to a control terminal of the first transistor of each of the plurality of variable impedance elements and control the second transistor of an ith (where $1 \leq i \leq N$) variable impedance element and the third transistor of an (i−1)th variable impedance element depending on an ith bit of the thermometer code.

The variable impedance circuit may include: a plurality of (N number of) (where N is an integer of 2 or greater) variable impedance elements connected in parallel; and an impedance controller configured to control the plurality of (N number of) variable impedance elements. Each of the variable impedance elements is configured such that an impedance of the variable impedance elements varies between a predetermined minimum value and a predetermined maximum value depending on the control signal. The impedance controller is configured to sequentially select the plurality of (N number of) variable impedance elements and change impedance of the selected variable impedance element from the maximum value toward the minimum value over time.

Also in this embodiment, it is possible to obtain a long time constant, like the case in which the variable impedance elements are connected in series.

The impedance controller may include: a first slope voltage source configured to start an operation to periodically and repeatedly generate a first slope voltage increased over time in response to the assertion of the conduction protection signal; and a counter configured to receive a period signal asserted at every period of the first slope voltage to generate an N-bit thermometer code. The impedance controller may be configured to select one of the variable impedance elements based on the thermometer code, control an impedance of the selected variable impedance element depending on the first slope voltage, and fix the impedance of the selected variable impedance element as the minimum value depending on the thermometer code.

Each of the variable impedance elements may include: a second resistor, a first transistor and a second transistor connected in series between one end of a low potential side of the second resistor and the ground line; and a third transistor installed between one end of a low potential side of the second resistor and the ground line. The impedance controller may be configured to output the first slope voltage to a control terminal of the first transistor of each of the plurality of variable impedance elements and control the second transistor of an ith (where $1 \leq i \leq N$) variable impedance element and the third transistor of an (i−1)th variable impedance element depending on an ith bit of the thermometer code.

The time-varying voltage generating circuit may include: a first node at which the time-varying voltage is output; a third resistor in which a potential of a first end is fixed and a second end is connected to the first node; and a slope current source connected to the third resistor and configured to generate a slope current changed over time in response to the assertion of the conduction protection signal. A voltage of the connection node of the third resistor and the slope current source may be the time-varying voltage.

When the slope current source is placed at a high potential side and the third resistor is placed at a low potential side, the time-varying voltage may be lowered by reducing the slope current over time.

Conversely, when the slope current source is placed at a low potential side and the third resistor is placed at a high potential side, the time-varying voltage may be lowered by increasing the slope current over time.

The slope current source may include: a differential transistor pair including a fourth transistor and a fifth transistor; a current source connected to the differential transistor pair; a first bias circuit configured to supply a predetermined first bias voltage to a control terminal of the fourth transistor; and a second bias circuit configured to generate a second bias voltage changed over time at a voltage level equal to the first bias voltage and supply the generated second bias voltage to a control terminal of the fifth transistor in response to the assertion of the conduction protection signal, wherein the slope current source may be configured to generate the slope current depending on a current flowing in the fifth transistor.

The first bias circuit may include: a fourth resistor installed between a second voltage line, to which a predetermined second voltage is supplied, and the control terminal of the fourth transistor; and a fifth transistor installed between the control terminal of the fourth transistor and the ground line. The second bias circuit may include: a sixth resistor installed between the second voltage line and the control terminal of the fifth transistor; and a variable impedance circuit installed between the control terminal of the fifth transistor and the ground line, and in which an impedance of the variable impedance circuit decreases from an initial impedance corresponding to the initial voltage toward zero over time in response to the assertion of the conduction protection signal.

The slope current source may include: a plurality of (N number of) (where N is an integer of 2 or greater) variable current sources; and a current controller configured to control the plurality of (N number of) variable current sources. Each of the variable current sources is configured such that an output current thereof varies between a predetermined minimum value and a predetermined maximum value depending on the control signal. The current controller may be configured to sequentially select the plurality of (N number of) variable current sources and change an output current of the selected variable current source between the maximum value and the minimum value over time. The slope current source may be configured to output a sum of output currents of the plurality of (N number of) variable current sources.

The current controller may include: a second slope voltage source configured to start an operation to periodically and repeatedly generate a second slope voltage changed over time in response to the assertion of the conduction protection signal; and a counter configured to receive a period signal asserted at every period of the second slope voltage to generate an N-bit thermometer code. The current controller may be configured to select one of the variable current sources based on the thermometer code, control an output current of the selected variable current source depending on the second slope voltage, and fix the output current of the selected variable current source as a final value depending on the thermometer code.

Each of the variable current sources may include: a differential transistor pair including a fourth transistor and a fifth transistor; a current source connected to the differential transistor pair; a first bias circuit configured to supply a predetermined first bias voltage to a control terminal of the fourth transistor; and a second bias circuit configured to supply a second bias voltage to a control terminal of the fifth transistor depending on the second slope voltage and the thermometer code, wherein each of the variable current sources may be configured to output a current flowing in the fifth transistor.

The amplifier may be configured to serve as an overcurrent protection circuit for changing a voltage of the control terminal of the switch element such that the coil current does not exceed the current limit, wherein the initial voltage may be determined based on the current limit.

Accordingly, it is possible to realize a soft shutoff function, while restraining an increase in a circuit area.

The amplifier may be configured to operate before the conduction protection signal is asserted, and to change a voltage of the control terminal of the switch element after the conduction protection signal is asserted.

The switch control device may be integrated in a single semiconductor substrate.

The term "integrated" may include a case in which all the components of a circuit are formed on a semiconductor substrate or a case in which major components of a circuit are integrated, and some resistors, capacitors, or the like may be installed outside the semiconductor substrate in order to adjust circuit constants.

According to another embodiment of the present disclosure, there is provided a vehicle, including: a gasoline engine; an ignition plug; an ECU configured to generate an ignition signal for instructing ignition of the ignition plug; and any one of the aforementioned igniters for driving the ignition coil depending on the ignition signal.

Further, arbitrarily combining the foregoing components or converting the expression of the present disclosure among a method, an apparatus, and the like is also effective as an embodiment of the present disclosure.

DETAILED DESCRIPTION

Figure 1:
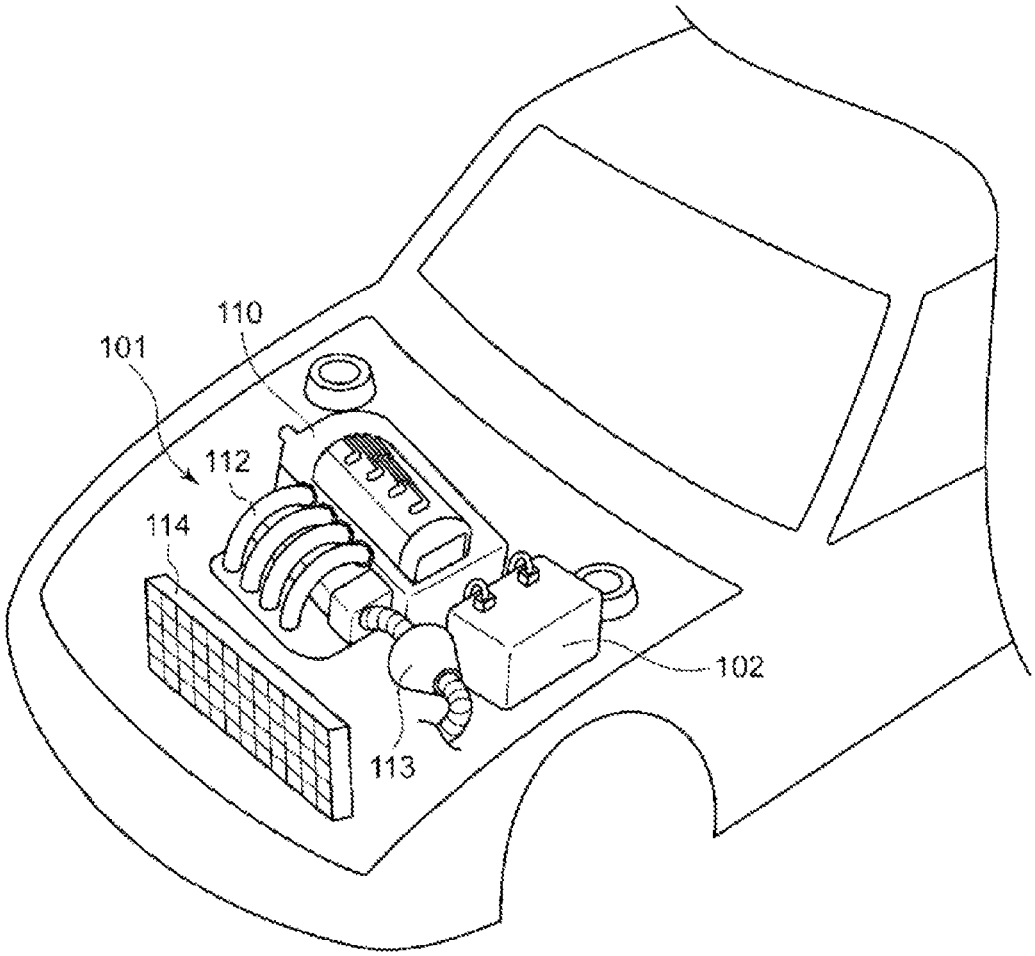
FIG. 1 (PRIOR ART)
FIG. 1 is a perspective view of an engine room of a gasoline engine vehicle.

Hereinafter, embodiments of the present disclosure will be described with reference to the accompanying drawings. Like or equivalent components, members, and processes illustrated in each drawing are given like reference numerals and a repeated description thereof will be properly omitted. Also, the embodiments are presented by way of example only, and are not intended to limit the present disclosure, and any feature or combination thereof described in the embodiments may not necessarily be essential to the present disclosure.

In the present disclosure, "a state where a member A is connected to a member B" includes a case where the member A and the member B are physically directly connected or even a case in which the member A and the member B are indirectly connected through any other member that does not affect an electrical connection state thereof.

Similarly, "a state where a member C is installed between a member A and a member B" also includes a case where the member A and the member C or the member B and the member C are indirectly connected through any other member that does not affect an electrical connection state, in addition to a case in which the member A and the member C or the member B and the member C are directly connected.

Figure 4:
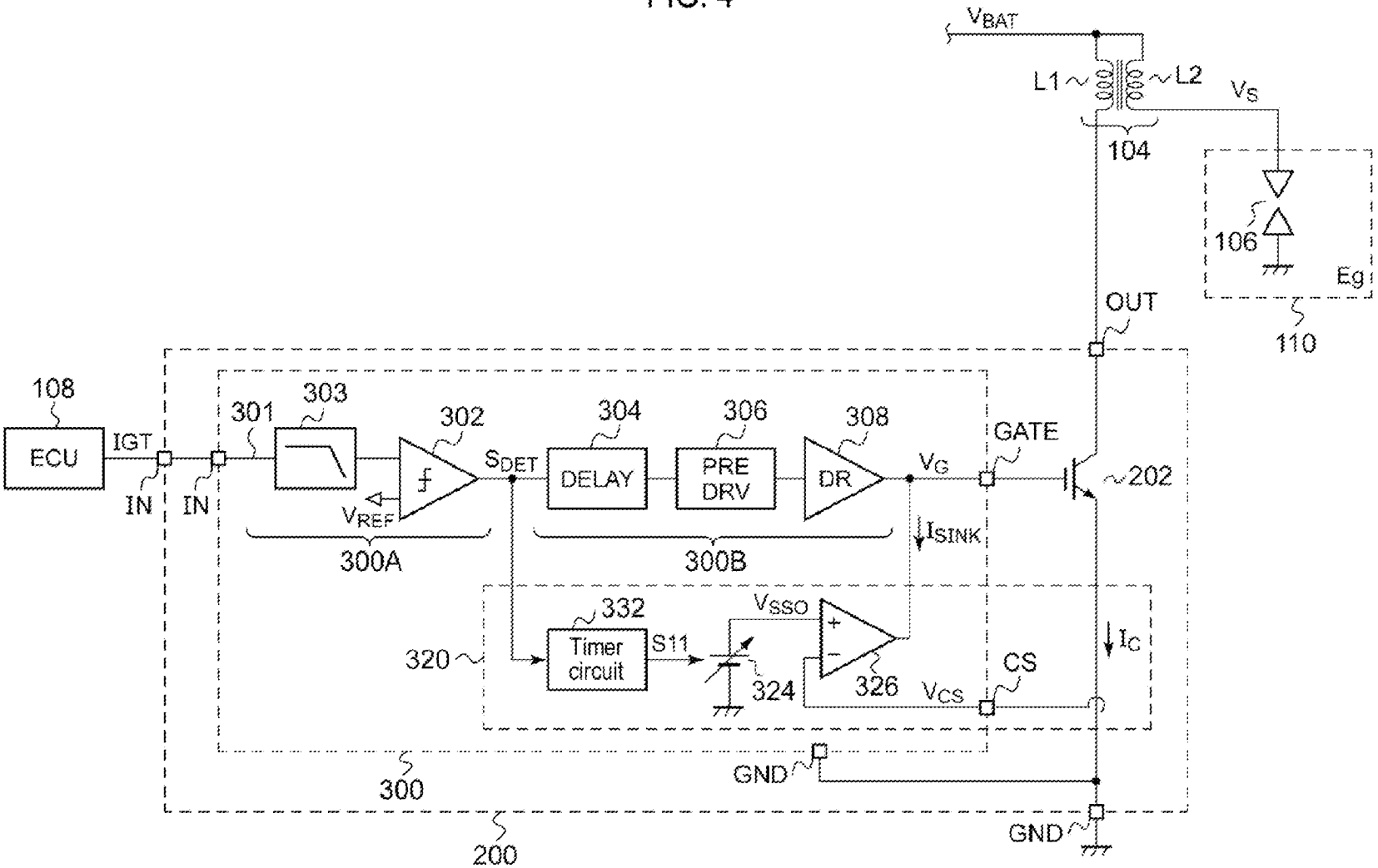
FIG. 4 is a circuit diagram of an igniter according to an embodiment.

FIG. 4 is a circuit diagram of an igniter 200 according to an embodiment. The igniter 200 receives an ignition signal IGT from an ECU 108 by an input terminal IN thereof, and controls a current (which is called a coil current or a collector current) of a primary coil L1 of an ignition coil 104 connected to an output terminal OUT thereof depending on the ignition signal IGT.

The igniter 200 has a switch element 202 and a switch control device 300, and is modularized to be accommodated in a single package.

The switch element 202 is, for example, an insulated gate bipolar transistor (IGBT). A collector of the switch element 202 is connected to the OUT terminal and an emitter thereof is grounded through a GND terminal. Also, as the switch element 202, a MOSFET may be used, and in this case, the emitter may be replaced with a source and the collector may be replaced with a drain.

Figure 2:
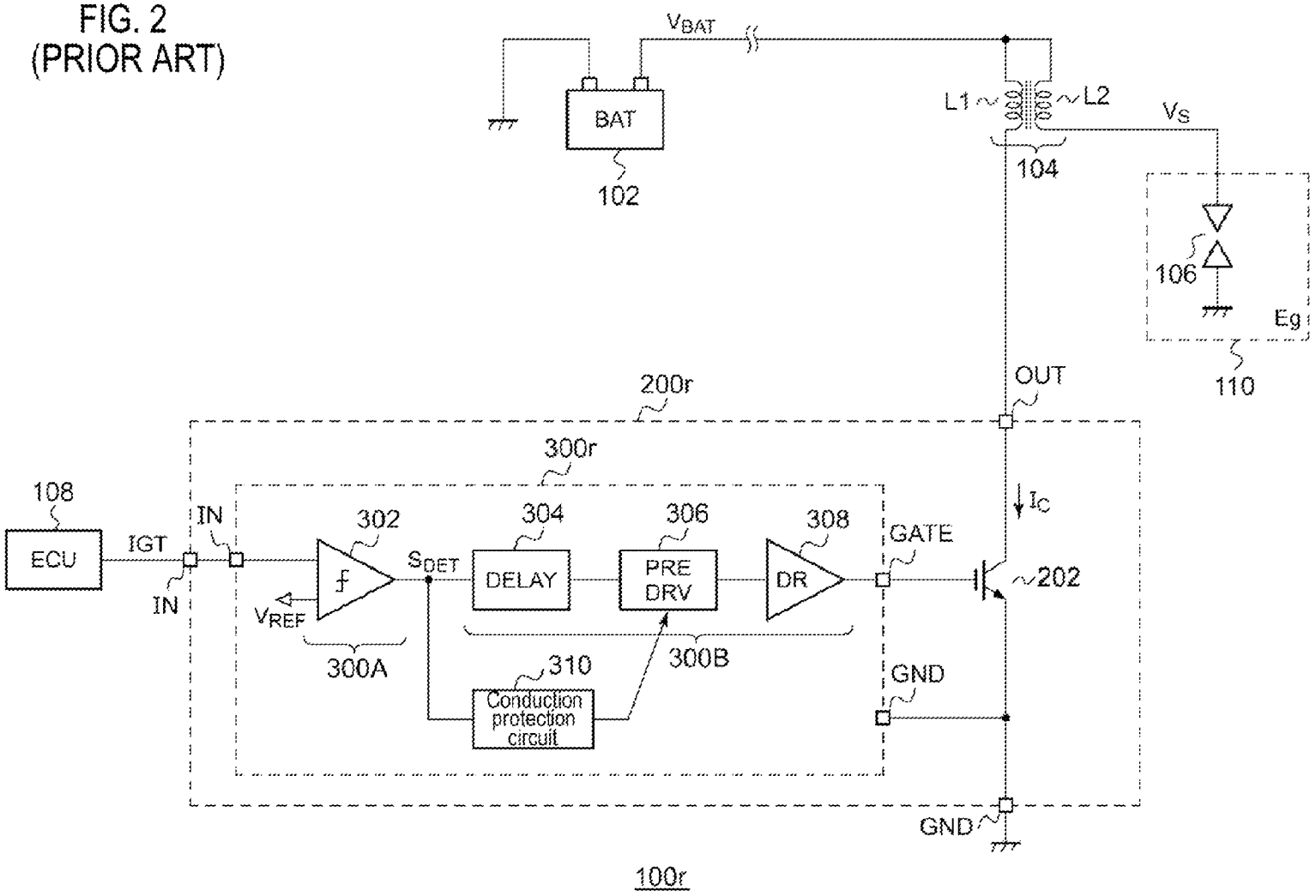
FIG. 2 (PRIOR ART)
FIG. 2 is a block diagram of part of an electric system of a vehicle.
Figure 3A:
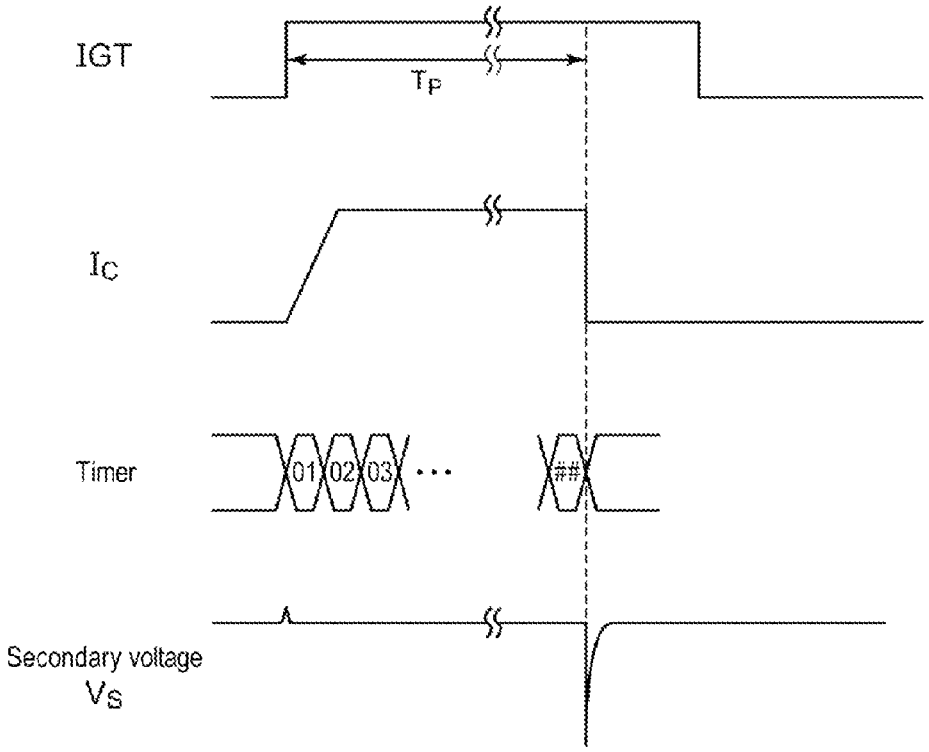
FIG. 3A (PRIOR ART)
FIGS. 3A and 3B are waveform views illustrating an operation of a conduction protection circuit.
Figure 3B:
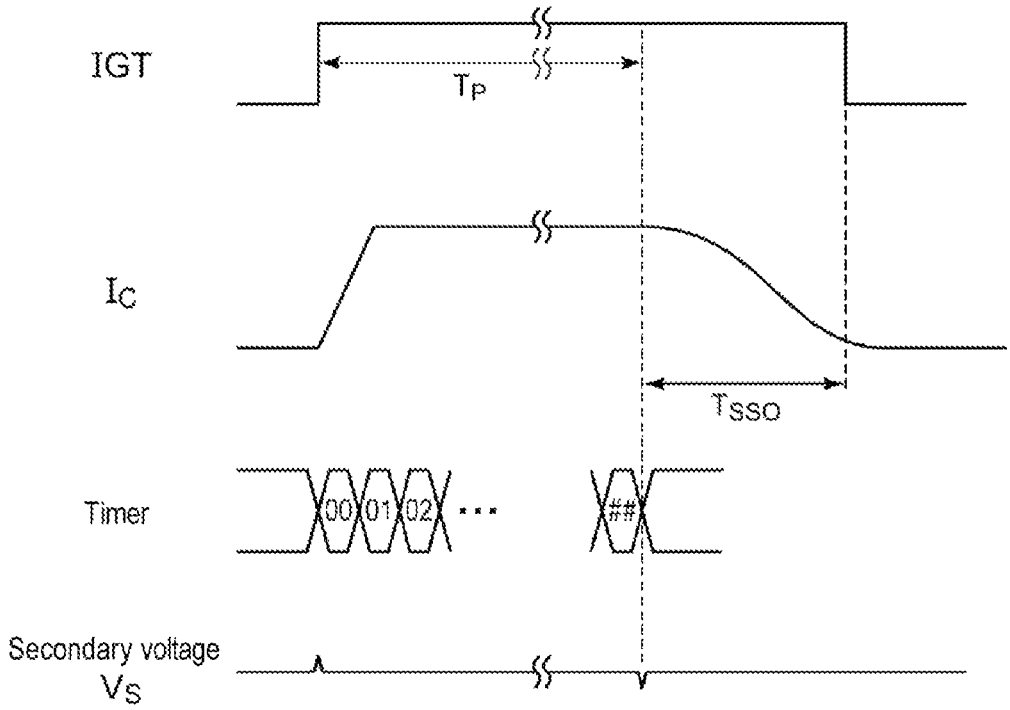
FIG. 3B (PRIOR ART)

A basic configuration of the switching control device 300 is the same as that of FIG. 2, has a determination stage 300A and a driving stage 300B, and is a functional integrated circuit (IC) integrated in a single semiconductor substrate.

The determination stage 300A has a high-frequency filter 303 and a determination comparator 302. The ignition signal IGT from the ECU 108 is input to the input line 301. The high-frequency filter 303 removes a high-frequency noise of the input line 301.

The determination comparator 302 compares an output voltage $V_{FIL}$ from the high-frequency filter 303 with a reference voltage $V_{REF}$ to generate a determination signal $S_{DET}$. In this embodiment, a state of $V_{FIL}>V_{REF}$ ($V_{IN}>V_{REF}$) corresponds to an ON state of the switch element 202 and a state of $V_{FIL}<V_{REF}$ ($V_{IN}<V_{REF}$) corresponds to an OFF state of the switch element 202. Further, the determination signal $S_{DET}$ becomes a high level (assertion) when $V_{FIL}>V_{REF}$, and becomes a low level (negation) when $V_{FIL}<V_{REF}$, and thus, the high level of the determination signal $S_{DET}$ is an assert level corresponding to ON of the switch element 202 and the low level of the determination signal $S_{DET}$ is a negative level corresponding to OFF of the switch element 202. Also, allocation of assertion and negation to the high level and the low level are matters of design and may be replaced.

The driving stage 300B controls ON/OFF of the switch element 202 depending on the determination signal $S_{DET}$ generated by the determination stage 300A. The driving stage 300B includes a delay circuit 304, a pre-driver 306, and a gate driver 308. The delay circuit 304 provides a predetermined delay Td1 to the determination signal $S_{DET}$. The delay amount Td1 is set such that a time difference (delay) between a time at which the ignition signal IGT transitions and a time at which the ignition plug is discharged has a predetermined value. The pre-driver 306 and the gate driver 308 control a voltage $V_G$ of a control terminal (gate) of the switch element 202 depending on an output S2 from the delay circuit 304.

Subsequently, a soft shutoff function of the igniter 200 will be described.

The switch control device 300 also has a soft shutoff circuit 320. The soft shutoff circuit 320 has a timer circuit 322, a time-varying voltage generating circuit 324, and an amplifier 326. When a state where the determination signal $S_{DET}$ becomes an assert level corresponding to ON of the switch element 202 continues for a predetermined conduction protection time τ, the timer circuit 322 asserts a conduction protection signal S11. The timer circuit 322 may be an analog timer or a digital timer, regardless of the type thereof.

When the conduction protection signal S11 is asserted, the time-varying voltage generating circuit 324 generates a time-varying voltage (soft shutoff voltage) $V_{SSO}$ lowered from an initial voltage $V_{INIT}$ over time. The amplifier 326 changes the gate voltage $V_G$ of the switch element 202 such that a detection voltage $V_{CS}$ that depends on the coil current $I_C$ flowing in the switch element 202 is close to the time varying voltage $V_{SSO}$. The amplifier 326 is configured to sink a current (sink current $I_{SINK}$) from a gate of the switch element 202. When the detection voltage $V_{CS}$ is higher than the time-varying voltage $V_{SSO}$, the amplifier 326 may discharge gate capacity of the switch element 202 by the sink current $I_{SINK}$ and lower the gate voltage $V_G$ of the switch element 202 such that the detection voltage $V_{CS}$ is close to the time-varying voltage $V_{SSO}$.

In this embodiment, the soft shutoff circuit 320 also serves as an overcurrent protection circuit for changing the gate voltage of the switch element 202 such that the coil current $I_C$ does not exceed a current limit $I_{CL}$. Further, the initial voltage $V_{INIT}$ of the time-varying voltage $V_{SSO}$ is determined depending on the current limit $I_{CL}$. Accordingly, a soft shutoff function may be realized, while restraining an increase in a circuit area.

The basic configuration of the igniter 200 has been described above. Subsequently, an operation thereof will be described.

Figure 5:
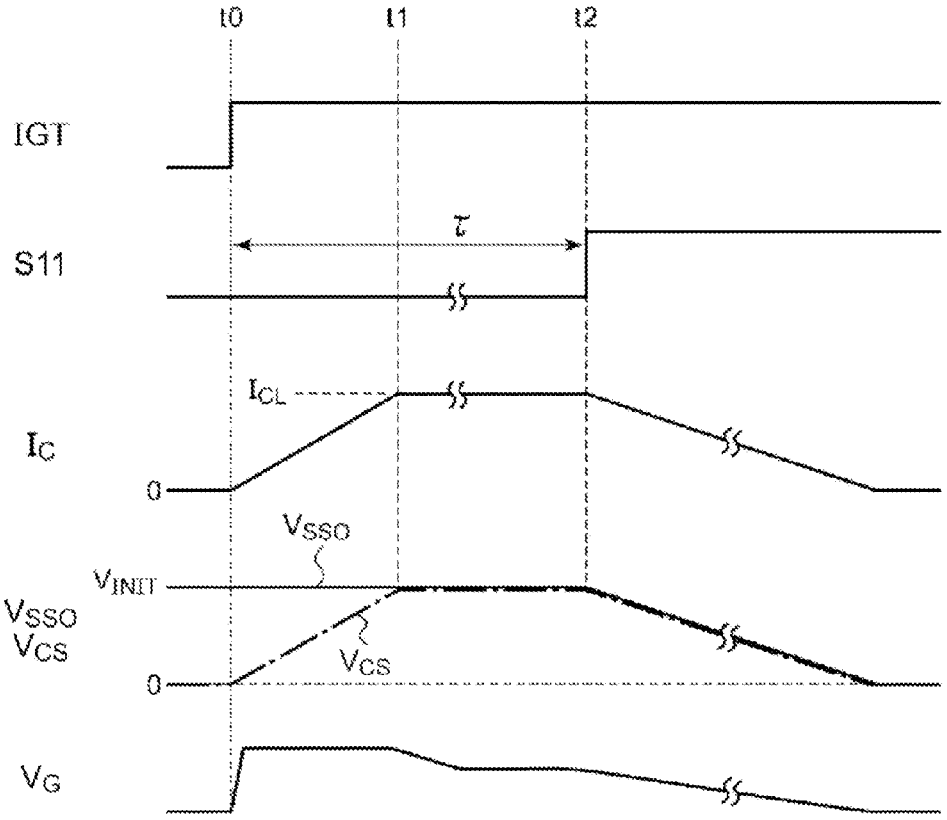
FIG. 5 is a waveform view illustrating an operation of the igniter of FIG. 4.

FIG. 5 is a waveform view illustrating an operation of the igniter 200 of FIG. 4.

At a time t0, the ignition signal IGT is asserted and the determination signal $S_{DET}$ transitions to a high level. The driving stage 300B applies a high level voltage to the gate of the switch element 202 to turn on the switch element 202. When the switch element 202 is turned on, the coil current $I_C$ is increased with a predetermined slope over time.

The time-varying voltage $V_{SSO}$ output by the time-varying voltage generating circuit 324 is the initial voltage $V_{INIT}$, and the soft shutoff circuit 320 operates as an overcurrent protection circuit for controlling the gate voltage $V_G$ of the switch element 202 such that the detection voltage $V_{CS}$ does not exceed the initial voltage $V_{INIT}$. When the detection voltage $V_{CS}$ reaches the time-varying voltage $V_{SSO}$ at a time t1, the gate voltage $V_G$ is lowered and the coil current $I_C$ is clamped at the current limit $I_{CL}$.

After the conduction protection time τ has lapsed starting from the time t0, the conduction protection signal S11 is asserted at a time t2. With this as momentum, the time-varying voltage generating circuit 324 lowers the time-varying voltage $V_{SSO}$ over time. Then, the gate voltage $V_G$ is controlled by the amplifier 326 such that the detection voltage $V_{CS}$ is lowered to follow the time-varying voltage $V_{SSO}$, and accordingly, the coil current $I_C$ is gradually reduced.

Thus, according to the igniter 200 of FIG. 4, soft shutoff may be realized. The igniter 200 may also realize soft shutoff by lowering the current limit $I_{CL}$ of the overcurrent protection circuit over time.

The present disclosure covers various circuits recognized by the block diagram and the circuit diagram of FIG. 4 or drawn from the foregoing description, without being limited to a specific circuit configuration. Hereinafter, a detailed configuration thereof will be described.

Figure 6:
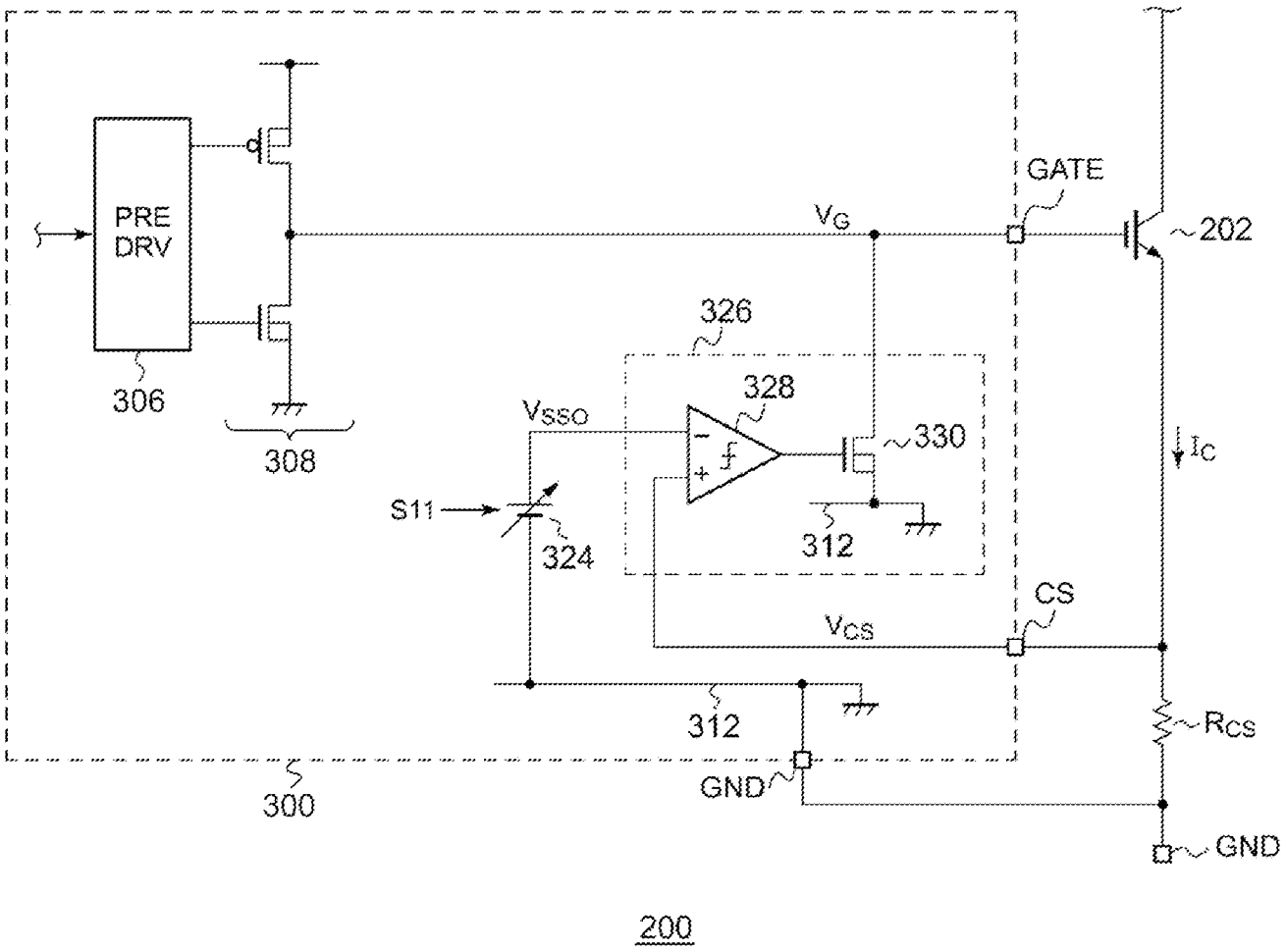
FIG. 6 is a circuit diagram illustrating a configuration example of an igniter.

FIG. 6 is a circuit diagram illustrating a configuration example of the igniter 200.

The amplifier 326 has a voltage comparator 328 and an output transistor 330. The output transistor 330 is installed between the control terminal (gate) of the switch element 202 and a ground line 312. The voltage comparator 328 compares the detection voltage $V_{CS}$ and the time-varying voltage $V_{SSO}$, and when the detection voltage $V_{CS}$ exceeds the time-varying voltage $V_{SSO}$, the voltage comparator 328 turns on the output transistor 330.

A current sensor resistor $R_{CS}$ is installed in a path of a collector current $I_C$, and more specifically, between the emitter of the switch element 202 and a GND terminal. The current sensor resistor $R_{CS}$ may be a chip component, a resistor component of a bonding wire, or a resistor integrated in an IC of the switch control device.

Subsequently, a configuration example of the time-varying voltage generating circuit 324 will be described.

Figure 7A:
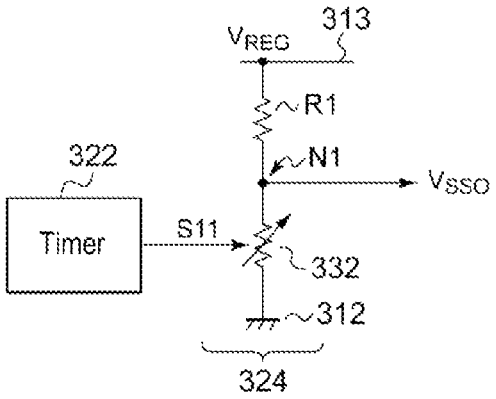
FIGS. 7A and 7B are circuit diagrams of a time-varying voltage generating circuit according to a first configuration example.
Figure 7B:
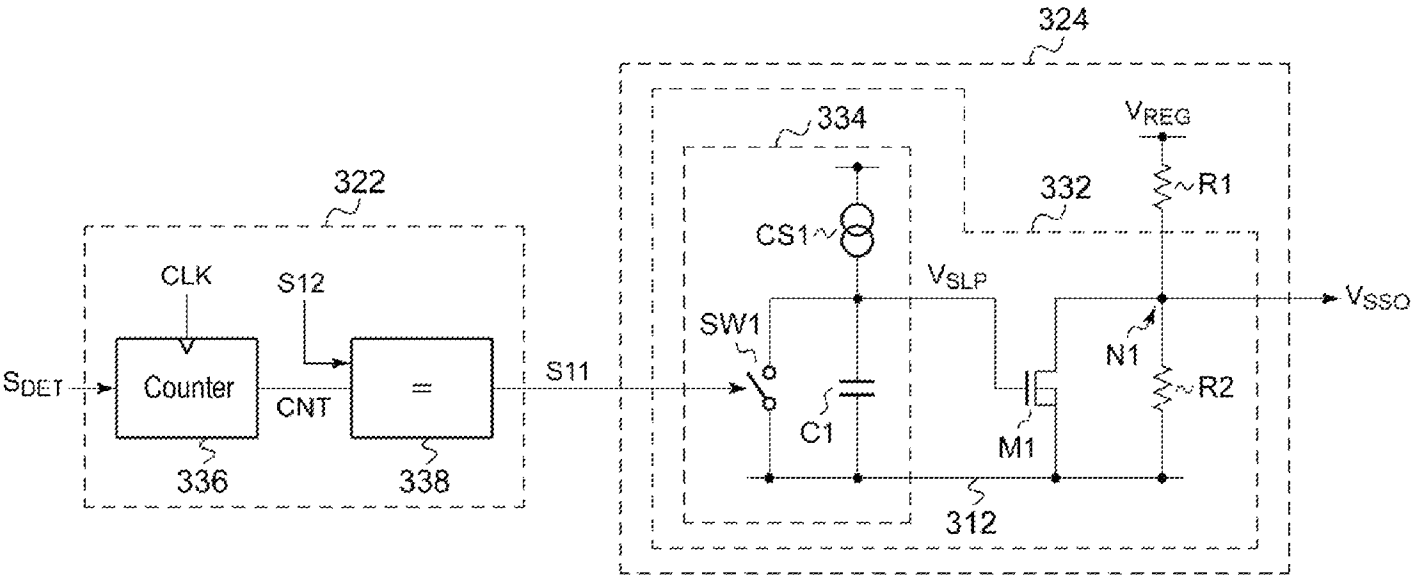

FIGS. 7A and 7B are circuit diagrams of a time-varying voltage generating circuit 324 according to a first configuration example.

The time-varying voltage generating circuit 324 has a first resistor R1, a first node N1, and a variable impedance circuit 332. A time-varying voltage $V_{SSO}$ is generated at the first node N1. The first resistor R1 is installed between a first voltage line 313 regulated with a predetermined first voltage level $V_{REG}$ and the first node N1. The variable impedance circuit 332 is installed between the first node N1 and the ground line 312. When the conduction protection signal S11 is asserted, an impedance Rv of the variable impedance circuit 332 is reduced from an initial impedance (maximum value) $R_{MAX}$ corresponding to the initial voltage $V_{INIT}$ to zero (minimum value $R_{MIN}$) over time.

With this configuration, the time-varying voltage $V_{SSO}$ of Eq. (1) may be generated.

$$V_{SSO}=V_{REG}\times Rv/(R1+Rv) \quad \text{Eq. (1)}$$

Further, by lowering the impedance Rv (resistance value) of the variable impedance circuit 332 from the maximum value $R_{MAX}$ toward the minimum value $R_{MIN}$ (=0), the time-varying voltage $V_{SSO}$ may be lowered from $V_{REG} \times R1/(R1+R_{MAX})$ to 0.

FIG. 7B is a circuit diagram of an embodiment of the timer circuit 322 and the time-varying voltage generating circuit 324 of FIG. 7A. The timer circuit 322 includes, for example, a counter 336 and a digital comparator 338. When the determination signal $S_{DET}$ is asserted, the counter 336 counts a clock CLK. When a count value CNT of the counter 336 becomes equal to a setting value S12 of the conduction protection time τ, the digital comparator 338 asserts the conduction protection signal S11.

The variable impedance circuit 332 has a second resistor R2, a first transistor M1, and a first slope voltage source 334. The second resistor R2 is installed between the first node N1 and the ground line 312. The first transistor M1 is an N-channel MOSFET, and is installed to be parallel to the second resistor R2. When the conduction protection signal S11 is asserted, the first slope voltage source 334 generates a first slope voltage $V_{SLP}$ increased over time and supplies the generated first slope voltage $V_{SLP}$ to the control terminal of the first transistor M1. A desirable waveform may be obtained with the time-varying voltage $V_{SSO}$ by increasing the first slope voltage $V_{SLP}$ with a predetermined slope linearly over time.

For example, the first slope voltage source 334 has a first capacitor C1, a first current source CS1, and a first switch SW1. One end of the first capacitor C1 is grounded, and the first current source CS1 supplies a predetermined constant current to the first capacitor C1. The first switch SW1 is installed to be parallel to the first capacitor C1, to control ON/OFF of the first switch SW1 in response to the conduction protection signal S11. A voltage of the first capacitor C1 is the first slope voltage $V_{SLP}$. Also, a configuration of the first slope voltage source 334 is not particularly limited and a known circuit may be used.

The time-varying voltage $V_{SSO}$ needs to be changed in the order of a few ms to hundreds of ms, and in this case, the first slope voltage $V_{SLP}$ may also need to be changed in the same order. When this is realized in the first slope voltage source 334 of FIG. 7B, resistance of tens of MΩ is required to reduce an amount of current of the first current source CS1 or a huge capacitor of a few nF is required as the first capacitor C1. Integration of these elements in a semiconductor chip of the switch control device 300*r* is not practical in terms of size, and an additional external chip component is required, increasing cost and an area.

Hereinafter, a technique of integrating the first slope voltage source 334 in a semiconductor chip will be described.

Figure 8A:
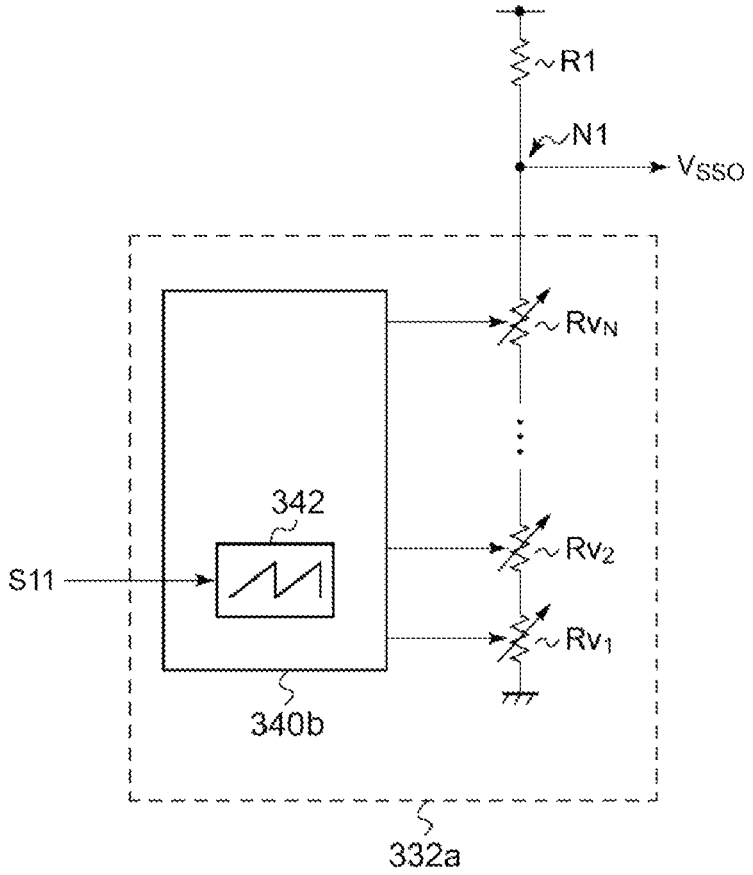
FIG. 8A is a circuit diagram of a time-varying voltage generating circuit according to a second configuration example.

FIG. 8A is a circuit diagram of a time-varying voltage generating circuit 324*a* according to a second configuration example. A variable impedance circuit 332*a* has N (where N is an integer of 2 or greater) number of variable impedance elements $Rv_1$ to $Rv_N$ connected in series between the first node N1 and the ground line 312 and an impedance controller 340*a* for controlling impedance of the plurality of variable impedance elements $Rv_1$ to $Rv_N$.

Each of the variable impedance elements Rv is configured such that impedance thereof is independently varied between a predetermined minimum value $R_{MIN}$ (zero) and a predetermined maximum value $R_{MAX}$ depending on the control signal. The impedance controller 340*a* sequentially selects a plurality of (N number of) variable impedance elements $Rv_1$ to $Rv_N$ and lowers impedance of the selected variable impedance element $Rv_1$ to $Rv_N$ from the maximum value $R_{MAX}$ toward the minimum value $R_{MIN}$ (zero) over time.

The impedance controller 340*a* includes a single first slope voltage source 342. The first slope voltage source 342 repeatedly generates a slope voltage $V_{SLP}$ having a period of 1/N of a time constant (transition time) $T_{SSO}$ required for the time-varying voltage $V_{SSO}$. Impedance of the selected variable impedance element Rv is controlled depending on the slope voltage $V_{SLP}$.

Thus, since the time constant required for the first slope voltage source 342 is sufficiently 1/N of the time constant of the first slope voltage source 334 of FIG. 7B, the component of the first slope voltage source 342 may be integrated in a semiconductor chip.

Figure 8B:
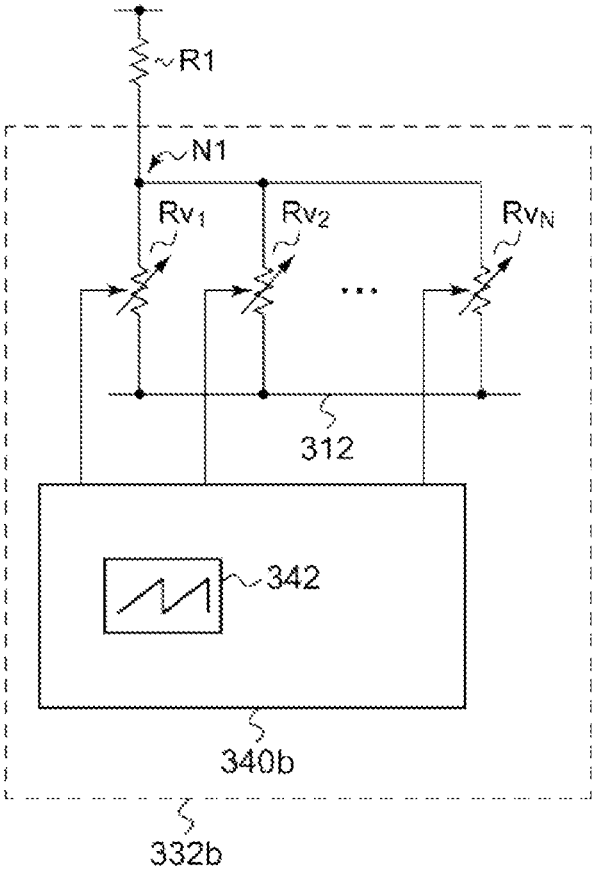
FIG. 8B is a circuit diagram of a time-varying voltage generating circuit according to a third configuration example.

FIG. 8B is a circuit diagram of a time-varying voltage generating circuit 324*b* according to a third configuration example. A variable impedance circuit 332*b* has N (where N is an integer of 2 or greater) number of variable impedance elements $Rv_1$ to $Rv_N$ connected in parallel between the first node N1 and the ground line 312 and an impedance controller 340*b* for controlling impedance of the plurality of variable impedance elements $Rv_1$ to $Rv_N$.

Each of the variable impedance elements Rv is configured such that impedance thereof is independently varied between a predetermined minimum value $R_{MIN}$ (non-zero) and a predetermined maximum value $R_{MAX}$ (substantially infinity) depending on the control signal. The impedance controller 340*b* sequentially selects a plurality of (N number of) variable impedance elements $Rv_1$ to $Rv_N$ and lowers impedance of the selected variable impedance element Rv from the maximum value (infinity) toward the minimum value over time. Also in this configuration, the same effect as that of the time-varying voltage generating circuit 324*a* of FIG. 8A may be obtained.

Figure 9:
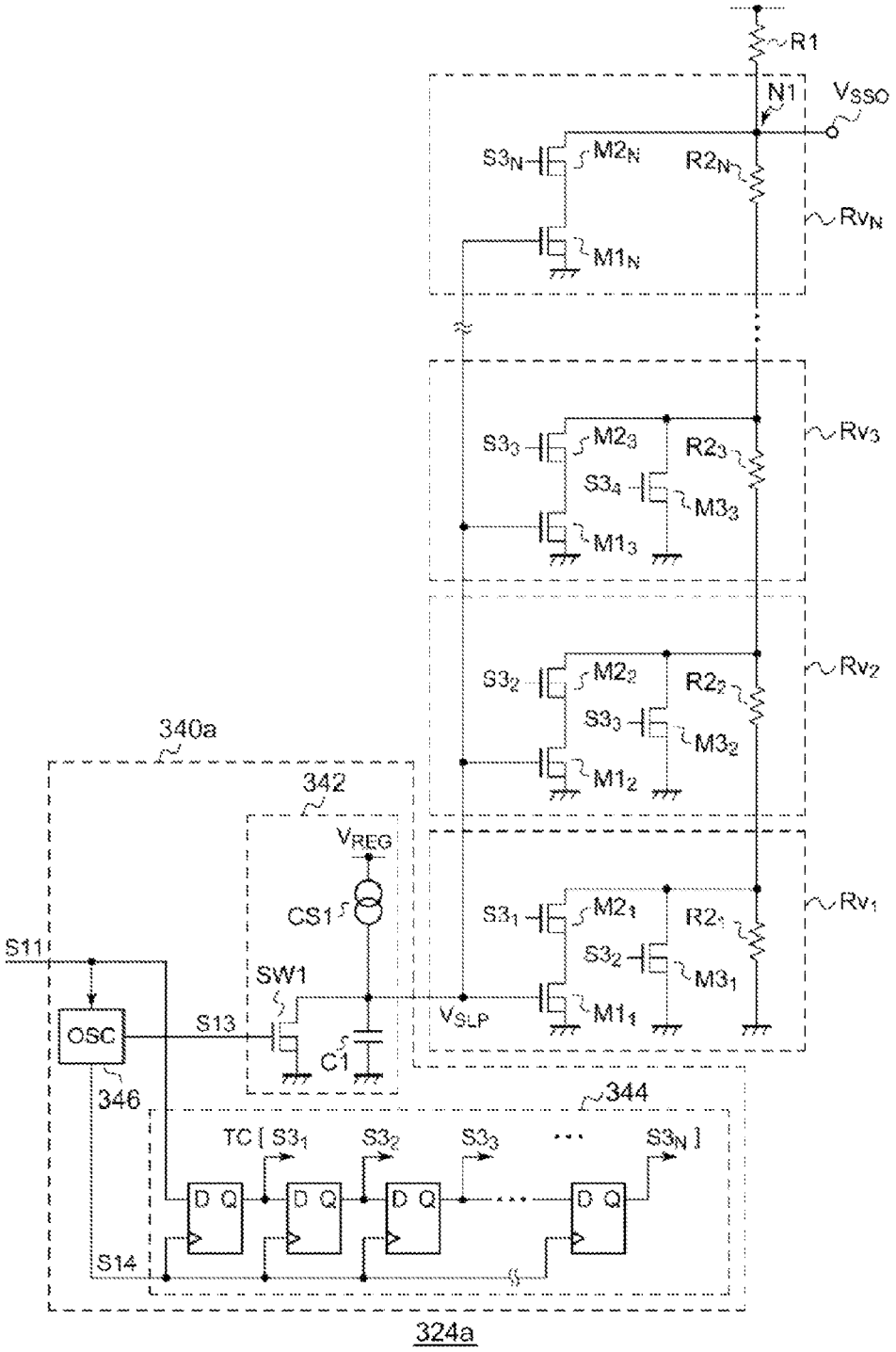
FIG. 9 is a circuit diagram of an embodiment of the time-varying voltage generating circuit of FIG. 8A.

FIG. 9 is a circuit diagram of an embodiment of the time-varying voltage generating circuit of FIG. 8A.

Each of the variable impedance elements Rv includes a second resistor R2, a first transistor M1, a second transistor M2, and a third transistor M3. Also, the third transistor M3 may be omitted in an Nth variable impedance element Rv.

Second resistors $R2_1$ to $R2_N$ of the plurality of variable impedance elements $Rv_1$ to $Rv_N$ are connected in series. A second transistor $M2_i$ (where $1 \leq i \leq N$) and a first transistor $M1_i$ are installed in series between one end of a high potential side of a corresponding second resistor $R2_i$ and a ground line. Also, a third transistor $M3_i$ is installed between one end of a high potential side of the corresponding second resistor $R2_i$ and the ground line.

The impedance controller 340*a* includes a counter 344 and an oscillator 346, in addition to the first slope voltage source 342. When the conduction protection signal S11 is asserted, the first slope voltage source 334 starts an operation to periodically and repeatedly generate the first slope voltage $V_{SLP}$ increased over time. The first slope voltage source 342 may be configured like the first slope voltage source 334 of FIG. 7B.

The oscillator 346 generates a period signal S13 asserted at every period of the first slope voltage $V_{SLP}$. The period signal S13 is input to the gate of the first switch SW1 to turn on the first switch SW1 at every predetermined period, and the first slope voltage $V_{SLP}$ is reset to zero.

The counter 344 receives a period signal S14 asserted at every period of the first slope voltage $V_{SLP}$, to generate an N-bit thermometer code TC. Bits of the thermometer code TC are control signals $S3_1$ to $S3_N$.

The impedance controller 340*a* selects one of the variable impedance elements Rv depending on the thermometer code TC, controls impedance of the selected variable impedance element Rv depending on the first slope voltage $V_{SLP}$, and fixes the impedance of the variable impedance element Rv already selected depending on the thermometer code TC as a minimum value. Specifically, the first slope voltage $V_{SLP}$ is output to the control terminal of the first transistor M1 of each of the plurality of variable impedance elements Rv. A second transistor $M2_i$ of an ith variable impedance element $Rv_i$ and a third transistor $M3_{i-1}$ of an (i−1)th variable impedance element $Rv_{i-1}$ are controlled depending on an ith bit (where $1 \le i \le N$) $S3_i$ of the thermometer code TC.

Also, the oscillator 346 may be omitted and the first slope voltage source 342 may be used as a self-propelled oscillator. In this case, a comparator for comparing the first slope voltage $V_{SLP}$ with a predetermined peak voltage may be added to the first slope voltage source 342, and the first switch SW1 may be controlled depending on an output from the comparator. Also, the counter 344 may be operated by using the output from the comparator.

Figure 10:
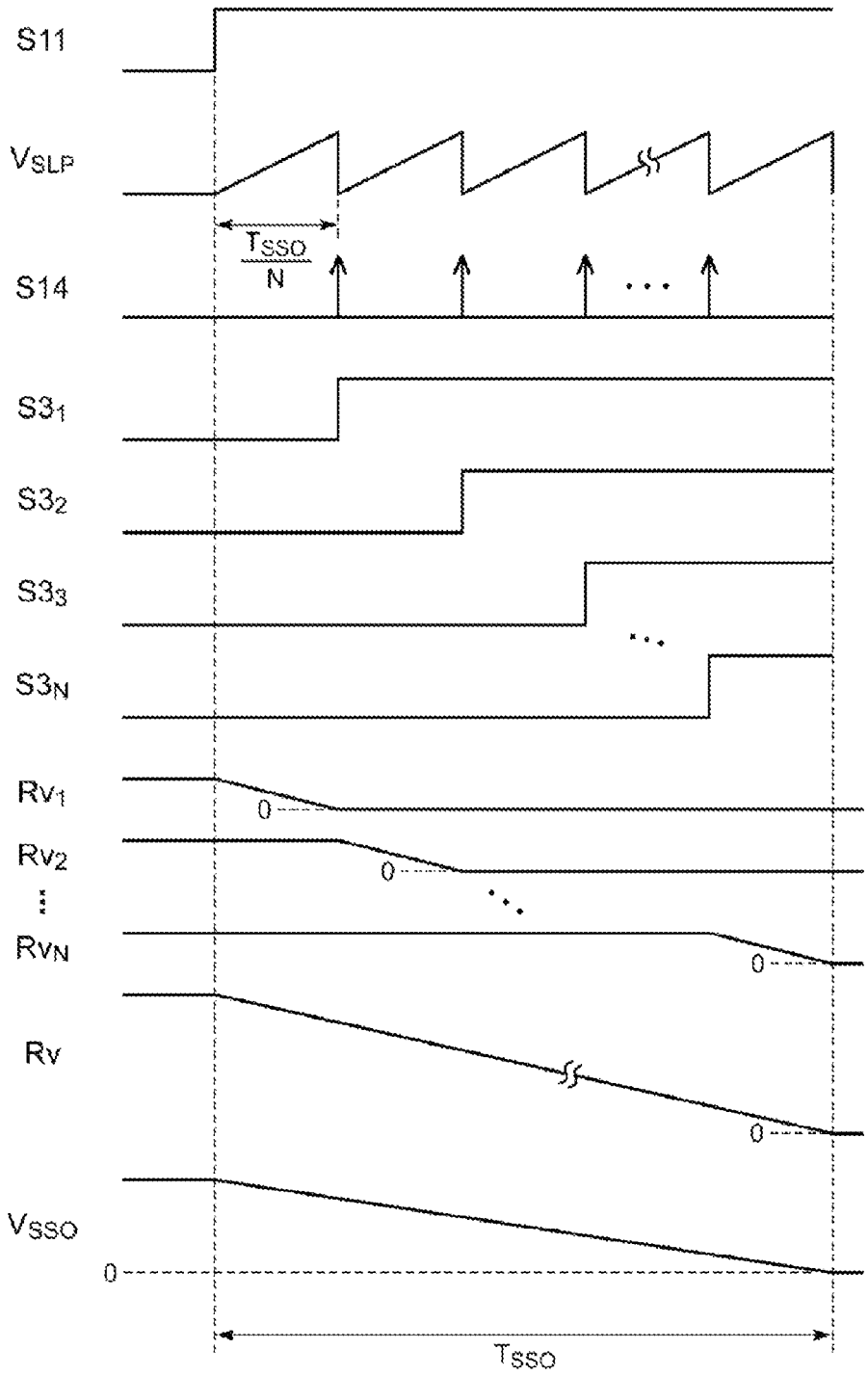
FIG. 10 is a waveform view illustrating an operation of the time-varying voltage generating circuit of FIG. 9.

FIG. 10 is a waveform view illustrating an operation of the time-varying voltage generating circuit 324 of FIG. 9. According to this time-varying voltage generating circuit 324 of FIG. 9, a long time constant $T_{SSO}$ may be realized by repeatedly using the slope voltage $V_{SLP}$ having the period $T_{SSO}/N$.

Figure 11:
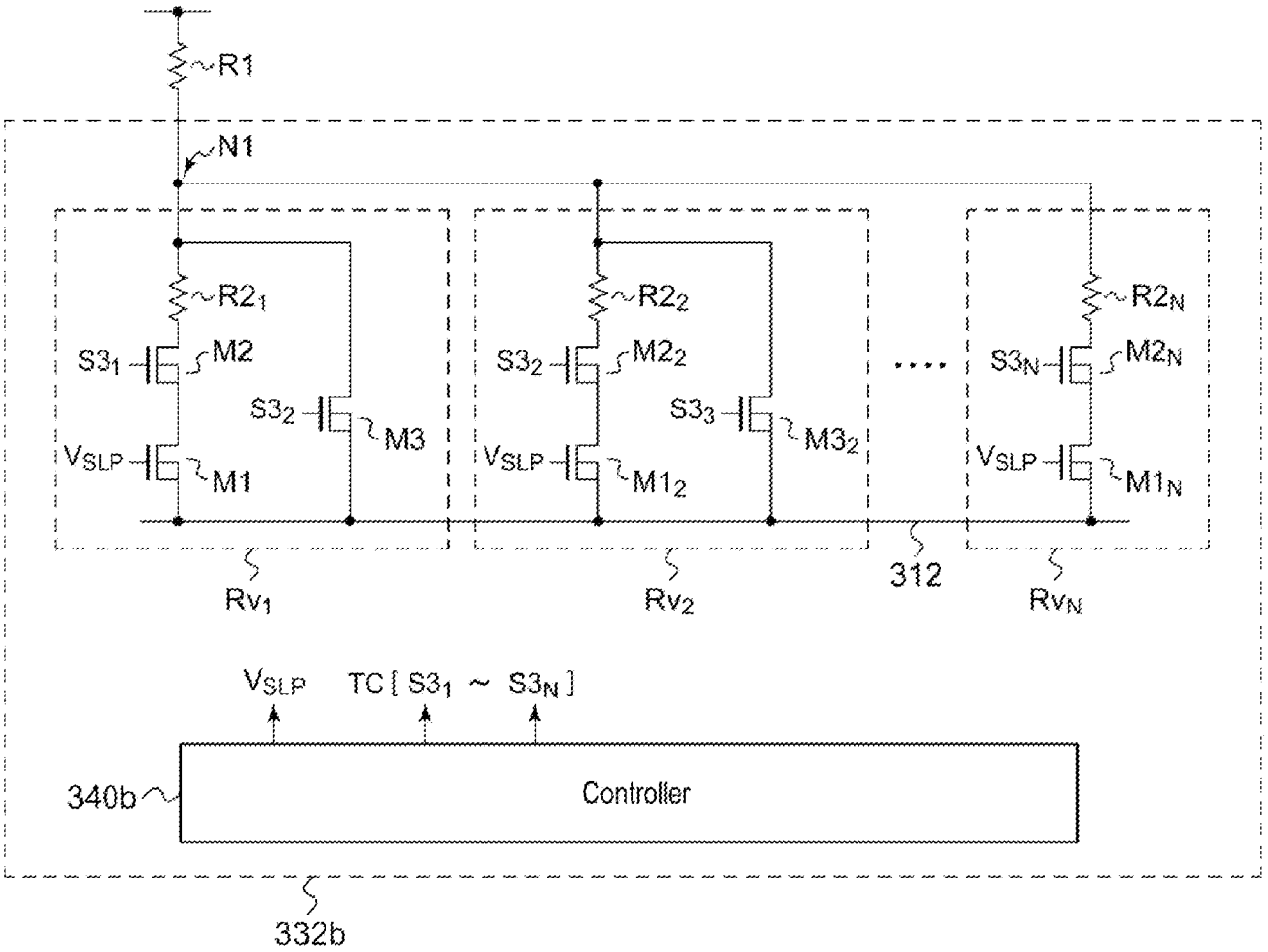
FIG. 11 is a circuit diagram of an embodiment of the time-varying voltage generating circuit of FIG. 8B.

FIG. 11 is a circuit diagram of an embodiment of the time-varying voltage generating circuit 324*b* of FIG. 8B.

The variable impedance elements $Rv_1$ to $Rv_N$ are configured in the same manner. Regarding an ith variable impedance element $Rv_i$, a second resistor $R2_i$, a second transistor $M2_i$, and a first transistor $M1_i$ are connected in series between the first node N1 and the ground line 312. A third transistor $M3_i$ is installed in parallel between both ends of the second resistor $R2_i$, the second transistor $M2_i$, and the first transistor $M1_i$. Regarding an Nth variable impedance element $Rv_N$, a third transistor $M3_N$ may be omitted.

The impedance controller 340*b* may be configured like the impedance controller 340*a* of FIG. 9. The impedance controller 340*b* selects one variable impedance element Rv depending on the thermometer code TC, controls impedance of the selected variable impedance element Rv depending on the first slope voltage $V_{SLP}$, and fixes the impedance of the variable impedance element Rv already selected depending on the thermometer code TC as a minimum value.

Specifically, the first slope voltage $V_{SLP}$ is input to the control terminal of the first transistor M1 of each of the variable impedance elements Rv. Further, a second transistor $M2_i$ of an ith (where $1 \le i \le N$) variable impedance element $Rv_1$ and a third transistor $M3_{i-1}$ of an (i−1)th variable impedance element $Rv_{i-1}$ are controlled depending on an ith bit $S3_i$ of the thermometer code TC.

With this configuration, the long time constant $T_{SSO}$ may be realized by repeatedly using the slope voltage $V_{SLP}$ of the period $T_{SSO}/N$.

Figure 12A:
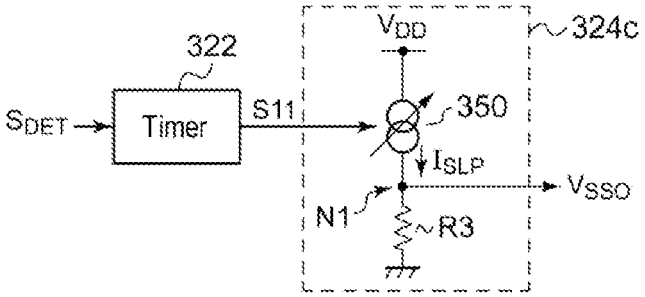
FIGS. 12A to 12C are circuit diagrams of a time-varying voltage generating circuit according to a fourth configuration example.
Figure 12B:
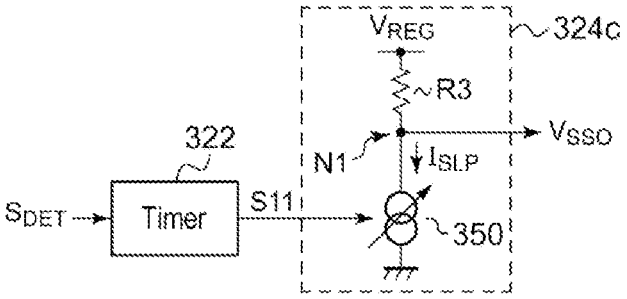
Figure 12C:
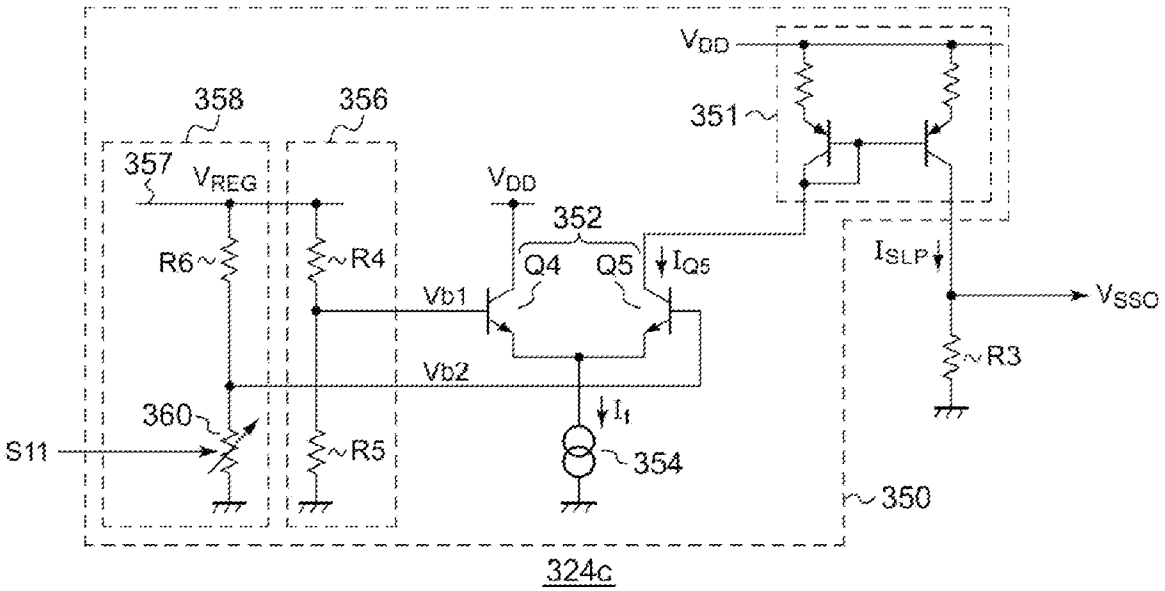

FIGS. 12A to 12C are circuit diagrams of a time-varying voltage generating circuit 324*c* according to a fourth configuration example.

As illustrated in FIGS. 12A and 12B, the time-varying voltage generating circuit 324*c* includes a third resistor R3 and a slope current source 350. A potential of one end of the time-varying voltage generating circuit 324*c* is fixed. The slope current source 350 is connected to the third resistor R3, and when the conduction protection signal S11 is asserted, the slope current source 350 generates a slope current $I_{SLP}$ changed over time. In FIG. 12A, a time-varying voltage $V_{SSO}$ may be generated by reducing the slope current $I_{SLP}$ from a maximum value toward zero over time. In FIG. 12B, the time-varying voltage $V_{SSO}$ may be generated by increasing the slope current $I_{SLP}$ from zero toward the maximum value over time.

FIG. 12C is a circuit diagram of an embodiment of the time-varying voltage generating circuit 324*c* of FIG. 12A. A slope current source 350 includes a differential transistor pair 352, a tail current source 354, a first bias circuit 356, and a second bias circuit 358. The differential transistor pair 352 includes a fourth transistor Q4 and a fifth transistor Q5. The tail current source 354 is connected to the differential transistor pair 352. The first bias circuit 356 supplies a predetermined first bias voltage Vb1 to a control terminal of the fourth transistor Q4. The second bias circuit 358 generates a second bias voltage Vb2 changed over time at the same voltage level as that of the first bias voltage Vb1 with assertion of the conduction protection signal S11 as momentum, and supplies the generated second bias voltage to a control terminal of the fifth transistor Q5. The slope current source 350 generates a slope current $I_{SLP}$ depending on a current flowing in the fifth transistor Q5. The transistors Q4 and Q5 may be bipolar transistors. For example, a current mirror circuit 351 for reversing a current $I_{Q5}$ and multiplying a predetermined coefficient thereto to generate the slope current $I_{SLP}$ is installed in the slope current source 350.

The first bias circuit 356 includes a fourth resistor R4 installed between a second voltage line 357 to which a predetermined second voltage $V_{REG}$ is supplied and the control terminal of the fourth transistor Q4, and a fifth resistor R5 installed between the control terminal of the fourth transistor Q4 and the ground line 312.

The second bias circuit 358 includes a sixth resistor R6 installed between the second voltage line 357 and the control terminal of the fifth transistor Q5 and a variable impedance circuit 360 installed between the control terminal of the fifth transistor and the ground line 312. With assertion of the conduction protection signal S11 as momentum, impedance of the variable impedance circuit 360 is reduced from an initial impedance R7 corresponding to the initial voltage $V_{INIT}$ toward zero over time. The variable impedance circuit 360 may be configured like the variable impedance circuit 332 described above.

An operation of the time-varying voltage generating circuit 324*c* of FIG. 12C will be described. It is assumed that R4=R6 and R5=R7. Before the conduction protection signal S11 is asserted, Vb1=Vb2 and $I_{Q5}=I_t/2$. When the conduction protection signal S11 is asserted, the impedance of the variable impedance circuit 360 is lowered and the second bias voltage Vb2 is lowered, so that the current $I_{Q5}$ and the slope current $I_{SLP}$ are reduced. Accordingly, the time-varying voltage $V_{SSO}$ lowered over time is generated.

Figure 13A:
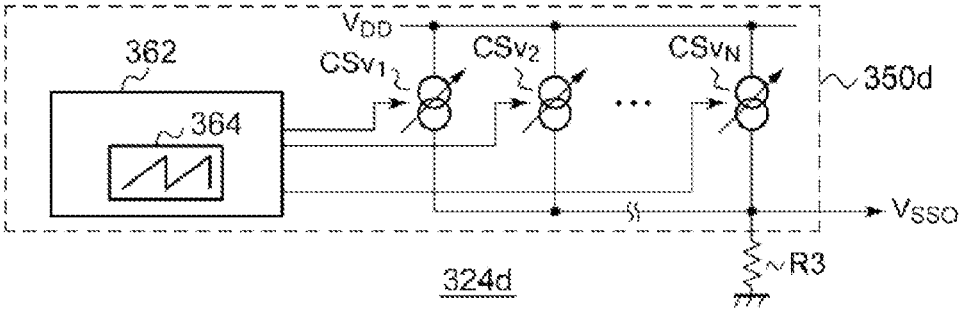
FIG. 13A is a circuit diagram of a time-varying voltage generating circuit according to a fifth configuration example.

FIG. 13A is a circuit diagram of a time-varying voltage generating circuit 324*d* according to a fifth configuration example. A slope current source 350*d* includes a plurality of (N number of) (where N is an integer of 2 or greater) variable current sources $CS_{V1}$ to $CS_{VN}$ and a current controller 362 for controlling the plurality of (N number of) variable current sources $CS_{V1}$ to $CS_{VN}$. An output current of each of the variable current sources $CS_V$ is configured to be varied between a predetermined minimum value and a predetermined maximum value depending on a control signal. The current controller 362 sequentially selects the plurality of (N number of) variable current sources $CS_{V1}$ to $CS_{VN}$ and changes an output current of the selected variable current source from the maximum value toward the minimum value over time. The slope current source 350*d* outputs a sum of the output currents of the plurality of (N number of) variable current sources $CS_{V1}$ to $CS_{VN}$.

The current controller 362 includes a single slope voltage source 364. The slope voltage source 364 repeatedly generates a slope voltage $V_{SLP}$ having a period of 1/N of the time constant (transition time) $T_{SSO}$ required for the time-varying voltage $V_{SSO}$. An output current of the selected variable impedance element $CS_V$ is controlled depending on the slope voltage $V_{SLP}$.

Thus, since the time constant required for the slope voltage source 364 is sufficiently 1/N of $T_{SSO}$, the component of the slope voltage source 364 may be integrated in a semiconductor chip.

Figure 13B:
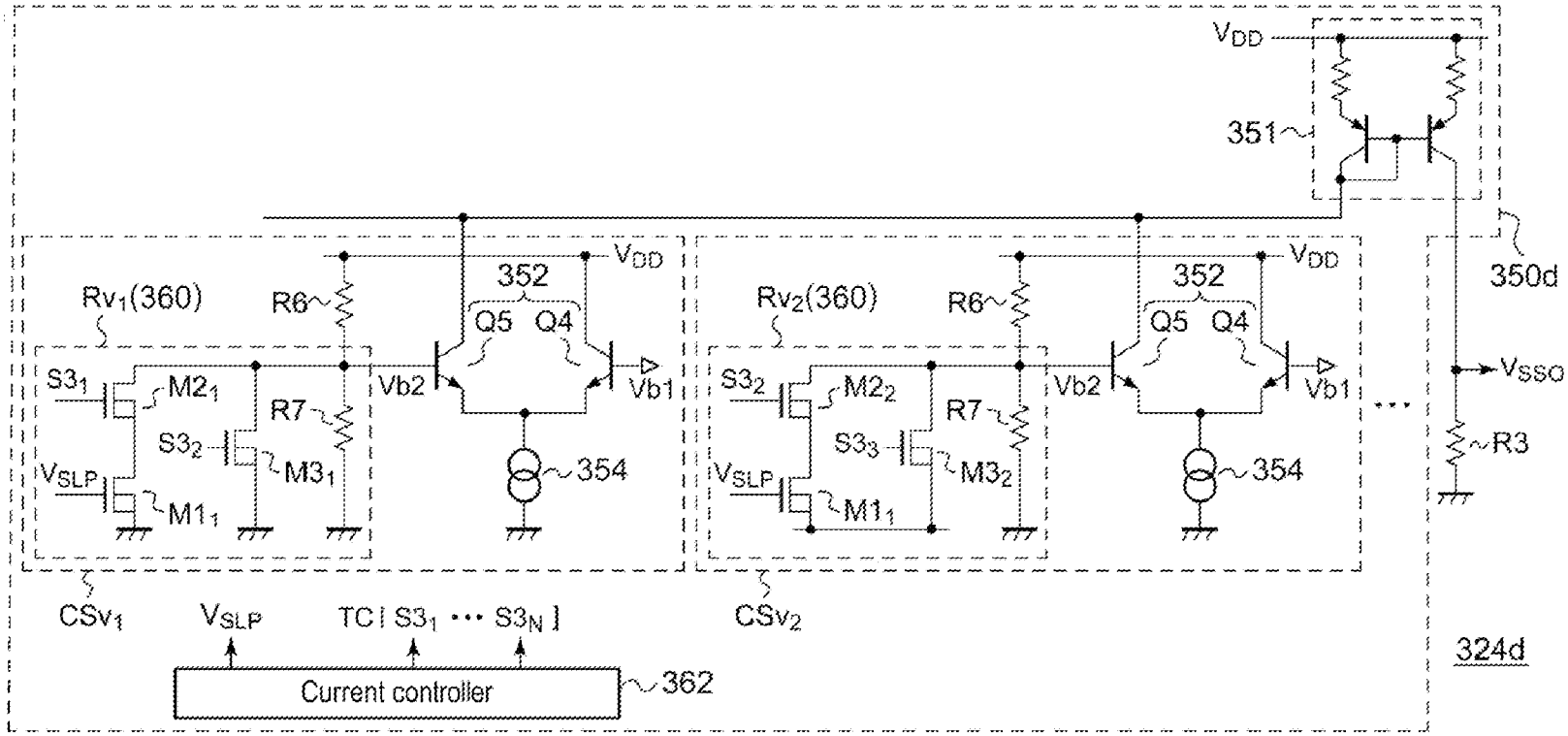
FIG. 13B is a circuit diagram of an embodiment of the time-varying voltage generating circuit of FIG. 13A.

FIG. 13B is a circuit diagram of an embodiment of the time-varying voltage generating circuit 324*d* of FIG. 13A. Immediately when a current mirror circuit 351 receives a sum current of the output currents of the plurality of variable current sources $CS_V$, the current mirror circuit 351 outputs the sum current to the third resistor R3. Each of the variable current sources $CS_V$ includes a differential transistor pair 352, a tail current source 354, a first bias circuit (not shown), and a variable impedance element Rv. The variable impedance element Rv includes a seventh resistor R7 and first to third transistors M1 to M3. The configuration of the variable impedance element Rv is the same as that of the variable impedance element Rv.

The current controller 362 is configured like the impedance controller 340*a* of FIG. 9, and the first to third transistors M1 to M3 are controlled in the same manner as those of FIG. 9.

Figure 14:
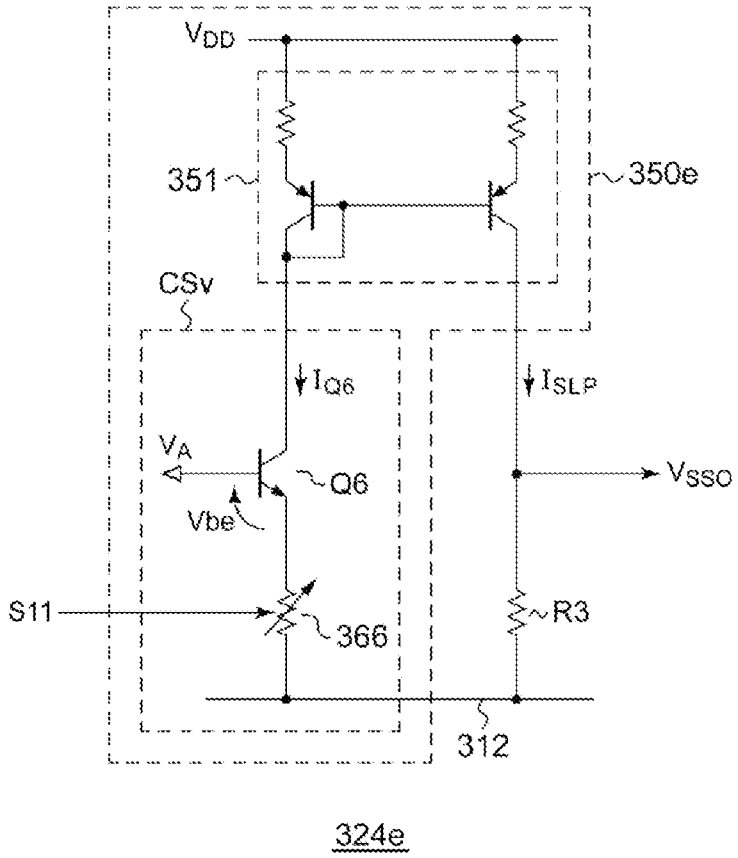
FIG. 14 is a circuit diagram of a time-varying voltage generating circuit according to a sixth configuration example.

FIG. 14 is a circuit diagram of a time-varying voltage generating circuit 324*e* according to a sixth configuration example. A slope current source 350*e* includes a current mirror circuit 351 and a variable current source $CS_V$. The variable current source $CS_V$ includes a sixth transistor Q6 and a variable impedance circuit 366. A predetermined voltage Va is input to a base (gate) of the sixth transistor Q6. The variable impedance circuit 366 is installed between an emitter (source) of the sixth transistor Q6 and the ground line 312. With assertion of the conduction protection signal S11 as momentum, impedance of the variable impedance circuit 366 is changed from an initial impedance corresponding to the initial voltage $V_{INIT}$ over time. The slope current source 350*e* generates a slope current $I_{SLP}$ depending on a current $I_{Q6}$ flowing in the sixth transistor Q6. The variable impedance circuit 366 may be configured like the aforementioned variable impedance circuit 332 or a modification thereof.

It is to be understood by those skilled in the art that the embodiments are merely illustrative and may be variously modified by any combination of the components or processes, and the modifications are also within the scope of the present disclosure. Hereinafter, these modifications will be described.

(First Modification)

Figure 15A:
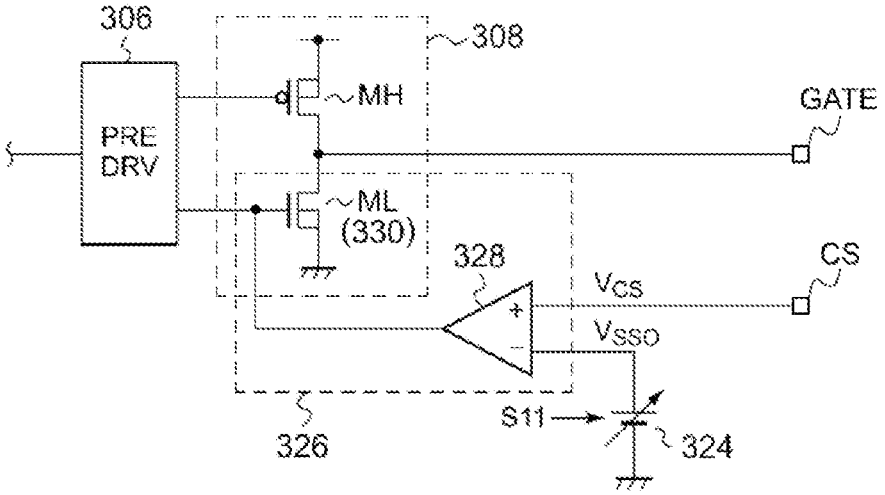
FIGS. 15A to 15C are circuit diagrams of part of an igniter according to first to third modifications.

FIG. 15A is a circuit diagram of part of an igniter 200 according to a first modification. In this modification, a low side transistor M1 of a gate driver 308 is commonly used with the output transistor 330 of the amplifier 326.

(Second Modification)

Figure 15B:
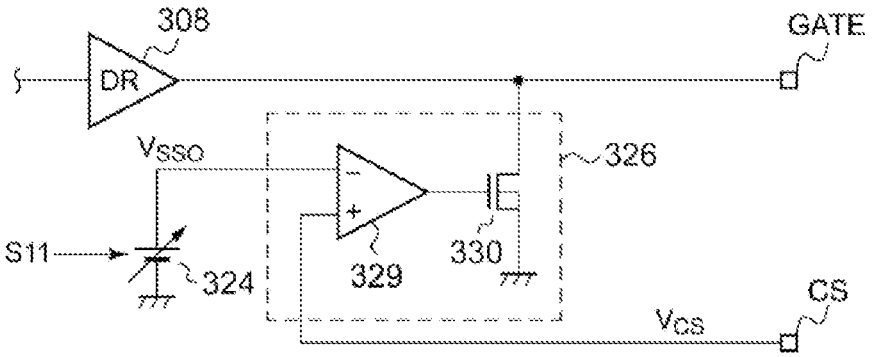

FIG. 15B is a circuit diagram of part of an igniter 200 according to a second modification. In this modification, the amplifier 326 includes an error amplifier 329 instead of the voltage comparator 328. The error amplifier 329 adjusts a voltage of the control terminal of the output transistor 330 depending on a difference between the detection voltage $V_{CS}$ and the time-varying voltage $V_{SSO}$.

(Third Modification)

Figure 15C:
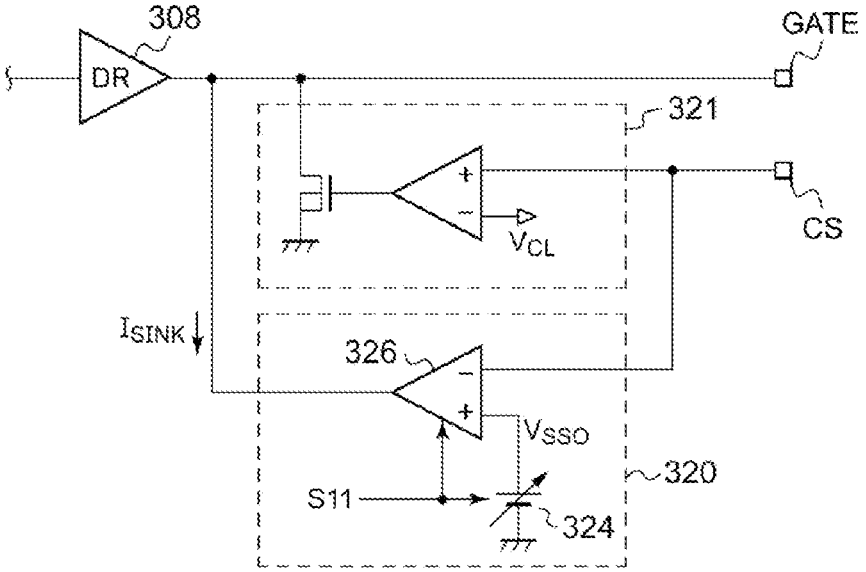

FIG. 15C is a circuit diagram of part of an igniter 200 according to a third modification. This modification further has an overcurrent protection circuit 321 in addition to the soft shutoff circuit 320. The amplifier 326 is not operated before the conduction protection signal S11 is asserted, and the amplifier 326 is operated to change a voltage of the control terminal of the switch element 202 after the conduction protection signal S11 is asserted.

(Fourth Modification)

In the embodiment, the coil current $I_C$ is detected by the current sense resistor $R_{CS}$, but the present disclosure is not limited thereto. In order to detect the coil current $I_C$, a current flowing in the switch element 202 may be duplicated by a current mirror circuit and the duplicated current may be detected, or the coil current may be detected by using an ON resistance of the switch element 202. Alternatively, an auxiliary winding may be added to the ignition coil 104 to estimate the coil current $I_C$ based on a current flowing in the auxiliary winding.

Also, the application of the time-varying voltage generating circuits 324 of FIGS. 8A and 8B, FIG. 9, FIG. 11, FIGS. 12A to 12C, FIGS. 13A and 13B, and FIG. 14 is not limited to the igniter 200 and they may be used for other purposes.

According to the present disclosure in some embodiments, it is possible to realize soft shutoff.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. An igniter, comprising:

a switch element connected to a primary coil of an ignition coil; and a switch control device configured to control the switch element depending on an ignition signal from an engine control unit (ECU), wherein the switch control device comprises:

a determination stage configured to compare a voltage associated with the ignition signal with a predetermined reference voltage to generate a determination signal;

a driving stage configured to control ON/OFF operations of the switch element depending on the determination signal;

a timer circuit configured to assert a conduction protection signal when a state where the determination signal becomes an assert level corresponding to the ON operation of the switch element continues for a predetermined conduction protection time;

a time-varying voltage generating circuit configured to generate a time-varying voltage which decreases from an initial voltage over time in response to the assertion of the conduction protection signal; and an amplifier configured to change a voltage of a control terminal of the switch element such that a detection voltage associated with a coil current flowing in the switch element is close to the time-varying voltage.

2. The igniter of claim 1, wherein the amplifier is configured to sink a current from the control terminal of the switch element.

3. The igniter of claim 1, wherein, when the detection voltage is higher than the time-varying voltage, the amplifier is configured to change the voltage of the control terminal of the switch element such that the detection voltage is close to the time-varying voltage.

4. The igniter of claim 1, wherein the amplifier comprises:

an output transistor installed between the control terminal of the switch element and a ground line; and a voltage comparator configured to compare the detection voltage with the time-varying voltage, and turn on the output transistor when the detection voltage exceeds the time-varying voltage.

5. The igniter of claim 1, wherein the amplifier comprises:

an output transistor installed between the control terminal of the switch element and a ground line; and an error amplifier configured to adjust a voltage of a control terminal of the output transistor depending on a difference between the detection voltage and the time-varying voltage.

6. The igniter of claim 1, wherein the time-varying voltage generating circuit comprises:

a first node at which the time-varying voltage is output;

a first resistor installed between a first voltage line regulated with a predetermined first voltage level and the first node; and a variable impedance circuit installed between the first node and a ground line, and in which an impedance of the variable impedance circuit decreases from an initial impedance corresponding to the initial voltage over time in response to the assertion of the conduction protection signal.

7. The igniter of claim 6, wherein the variable impedance circuit comprises:

a second resistor installed between the first node and the ground line;

a first transistor installed to be parallel to the second resistor; and a slope voltage source configured to generate a first slope voltage increased over time and supply the generated first slope voltage to a control terminal of the first transistor in response to the assertion of the conduction protection signal.

8. The igniter of claim 7, wherein the first slope voltage source comprises:

a first capacitor;

a first current source configured to supply a predetermined current to the first capacitor; and a first switch installed to be parallel to the first capacitor, and in which ON/OFF operations of the first switch are controlled in response to the conduction protection signal, and wherein a voltage of the first capacitor is the first slope voltage.

9. The igniter of claim 6, wherein the variable impedance circuit comprises:

a plurality of variable impedance elements connected in series, wherein each of the variable impedance elements is configured such that an impedance of each of the variable impedance elements varies between a predetermined minimum value and a predetermined maximum value depending on the control signal; and an impedance controller configured to control the plurality of variable impedance elements, wherein the impedance controller is configured to sequentially select one of the plurality of variable impedance elements and change an impedance of the selected variable impedance element from the predetermined maximum value toward the predetermined minimum value over time.

10. The igniter of claim 9, wherein the impedance controller comprises:

a first slope voltage source configured to start an operation to periodically and repeatedly generate a first slope voltage increased over time in response to the assertion of the conduction protection signal; and a counter configured to receive a period signal asserted at every period of the first slope voltage to generate an N-bit thermometer code, and wherein the impedance controller is configured to select one of the variable impedance elements based on the thermometer code, control an impedance of the selected variable impedance element depending on the first slope voltage, and fix the impedance of the selected variable impedance element as the minimum value depending on the thermometer code.

11. The igniter of claim 10, wherein each of the variable impedance elements comprises:

a second resistor;

a first transistor and a second transistor installed in series between one end of a high potential side of the second resistor and the ground line; and a third transistor installed between one end of a high potential side of the second resistor and the ground line, and wherein the impedance controller is configured to output the first slope voltage to a control terminal of the first transistor of each of the plurality of variable impedance elements and control the second transistor of an ith (where $1 \leq i \leq N$) variable impedance element and the third transistor of an (i−1)th variable impedance element depending on an ith bit of the thermometer code.

12. The igniter of claim 6, wherein the variable impedance circuit comprises:

a plurality of variable impedance elements connected in parallel, wherein each of the variable impedance elements is configured such that an impedance of the variable impedance elements varies between a predetermined minimum value and a predetermined maximum value depending on the control signal; and an impedance controller configured to control the plurality of variable impedance elements, wherein the impedance controller is configured to sequentially select the plurality of variable impedance elements and change impedance of the selected variable impedance element from the predetermined maximum value toward the predetermined minimum value over time.

13. The igniter of claim 12, wherein the impedance controller comprises:

a first slope voltage source configured to start an operation to periodically and repeatedly generate a first slope voltage increased over time in response to the assertion of the conduction protection signal; and a counter configured to receive a period signal asserted at every period of the first slope voltage to generate an N-bit thermometer code, and wherein the impedance controller is configured to select one of the variable impedance elements depending on the thermometer code, control an impedance of the selected variable impedance element depending on the first slope voltage, and fix the impedance of the selected variable impedance element as the minimum value depending on the thermometer code.

14. The igniter of claim 13, wherein each of the variable impedance elements comprises:

a second resistor, a first transistor, and a second transistor connected in series between the first node and the ground line; and a third transistor installed between both ends of the second resistor, the first transistor and the second transistor, and wherein the impedance controller is configured to output the first slope voltage to a control terminal of the first transistor of each of the plurality of variable impedance elements and control the second transistor of an ith (where $1 \leq i \leq N$) variable impedance element and the third transistor of an (i−1)th variable impedance element depending on an ith bit of the thermometer code.

15. The igniter of claim 1, wherein the time-varying voltage generating circuit comprises:

a first node at which the time-varying voltage is output;

a third resistor in which a potential of a first end is fixed and a second end is connected to the first node; and a slope current source connected to the third resistor and configured to generate a slope current changed over time in response to the assertion of the conduction protection signal.

16. The igniter of claim 15, wherein the slope current source comprises:

a differential transistor pair including a fourth transistor and a fifth transistor;

a tail current source connected to the differential transistor pair;

a first bias circuit configured to supply a predetermined first bias voltage to a control terminal of the fourth transistor; and a second bias circuit configured to generate a second bias voltage changed over time at a voltage level equal to the first bias voltage and supply the generated second bias voltage to a control terminal of the fifth transistor in response to the assertion of the conduction protection signal, and wherein the slope current source is configured to generate the slope current depending on a current flowing in the fifth transistor.

17. The igniter of claim 16, wherein the first bias circuit comprises:

a fourth resistor installed between a second voltage line, to which a predetermined second voltage is supplied, and the control terminal of the fourth transistor; and a fifth transistor installed between the control terminal of the fourth transistor and the ground line, and wherein the second bias circuit comprises:

a sixth resistor installed between the second voltage line and the control terminal of the fifth transistor; and a variable impedance circuit installed between the control terminal of the fifth transistor and the ground line, and in which an impedance of the variable impedance circuit decreases from an initial impedance corresponding to the initial voltage toward zero over time, in response to the assertion of the conduction protection signal.

18. The igniter of claim 15, wherein the slope current source comprises:

a plurality of variable current sources, wherein each of the variable current sources is configured such that an output current thereof varies between a predetermined minimum value and a predetermined maximum value depending on a control signal; and a current controller configured to control the plurality of variable current sources, wherein the current controller is configured to sequentially select the plurality of variable current sources and change an output current of the selected variable current source between the predetermined maximum value and the predetermined minimum value over time, and wherein the slope current source is configured to output a sum of output currents of the plurality of variable current sources.

19. The igniter of claim 18, wherein the current controller comprises:

a second slope voltage source configured to start an operation to periodically and repeatedly generate a second slope voltage changed over time in response to the assertion of the conduction protection signal; and a counter configured to receive a period signal asserted at every period of the second slope voltage to generate an N-bit thermometer code, and wherein the current controller is configured to select one of the variable current sources based on the thermometer code, control an output current of the selected variable current source depending on the second slope voltage, and fix the output current of the selected variable current source as a final value depending on the thermometer code.

20. The igniter of claim 19, wherein each of the variable current sources comprises:

a differential transistor pair including a fourth transistor and a fifth transistor;

a tail current source connected to the differential transistor pair;

a first bias circuit configured to supply a predetermined first bias voltage to a control terminal of the fourth transistor; and a second bias circuit configured to supply a second bias voltage to a control terminal of the fifth transistor depending on the second slope voltage and the thermometer code, and wherein each of the variable current sources is configured to output a current flowing in the fifth transistor.

21. The igniter of claim 15, wherein the slope current source comprises:

a sixth transistor, a predetermined voltage being applied to a base/gate of the sixth transistor; and a variable impedance circuit installed between an emitter/source of the sixth transistor and the ground line, and in which an impedance of the variable impedance circuit changes from an initial impedance corresponding to the initial voltage over time in response to the assertion of the conduction protection signal, and wherein the slope current source is configured to generate the slope current depending on a current flowing in the sixth transistor.

22. The igniter of claim 1, wherein the amplifier is configured to serve as an overcurrent protection circuit for changing a voltage of the control terminal of the switch element such that the coil current does not exceed a current limit, wherein the initial voltage is determined based on the current limit.

23. The igniter of claim 1, wherein the amplifier is configured not to operate before the conduction protection signal is asserted, and to change a voltage of the control terminal of the switch element after the conduction protection signal is asserted.

24. The igniter of claim 1, wherein the switch control device is integrated in a single semiconductor substrate.

25. A vehicle, comprising:

a gasoline engine;

an ignition plug;

an ignition coil having a primary coil and a secondary coil connected to the ignition plug;

an ECU configured to generate an ignition signal for instructing ignition of the ignition plug; and the igniter of claim 1, configured to drive the ignition coil depending on the ignition signal.

26. A method for controlling an ignition coil connected to an ignition plug, comprising:

generating an ignition signal for instructing ignition of the ignition plug by an engine control unit (ECU);

comparing a voltage of an input line, to which the ignition signal is transmitted, with a reference voltage to generate a determination signal;

controlling ON/OFF operations of a switch element connected to a primary coil of the ignition coil depending on the determination signal;

asserting a conduction protection signal when a state where the determination signal becomes an assert level corresponding to the ON operation of the switch element continues for a predetermined conduction protection time;

generating a time-varying voltage which decreases from an initial voltage over time in response to the assertion of the conduction protection signal; and changing a voltage of a control terminal of the switch element such that a detection voltage associated with a coil current flowing in the switch element is close to the time-varying voltage.

* * * * *